US011826979B2

(12) United States Patent
Miyashita et al.

(10) Patent No.: US 11,826,979 B2
(45) Date of Patent: Nov. 28, 2023

(54) CORRUGATED PAPERBOARD BOX MAKING MACHINE

(71) Applicant: KABUSHIKI KAISHA ISOWA, Nagoya (JP)

(72) Inventors: Shunsuke Miyashita, Kitanagoya (JP); Shunsuke Nakanishi, Komaki (JP)

(73) Assignee: KABUSHIKI KAISHA ISOWA, Aichi (JP)

( * ) Notice: Subject to any disclaimer, the term of this patent is extended or adjusted under 35 U.S.C. 154(b) by 42 days.

(21) Appl. No.: 17/464,045

(22) Filed: Sep. 1, 2021

(65) Prior Publication Data

US 2022/0097334 A1 Mar. 31, 2022

(30) Foreign Application Priority Data

Sep. 25, 2020 (JP) ..... 2020-160850

(51) Int. Cl.

| | |
|---|---|
| ***B31B 50/22*** | (2017.01) |
| ***B31B 50/14*** | (2017.01) |
| ***B31B 50/00*** | (2017.01) |
| ***B26D 1/28*** | (2006.01) |
| ***B26D 5/00*** | (2006.01) |
| ***B31B 50/04*** | (2017.01) |
| ***B31B 120/70*** | (2017.01) |

(52) U.S. Cl.

CPC ..... *B31B 50/22* (2017.08); *B26D 1/285* (2013.01); *B26D 5/00* (2013.01); *B31B 50/006* (2017.08); *B31B 50/042* (2017.08); *B31B 50/146* (2017.08); *B31B 2120/70* (2017.08)

(58) Field of Classification Search

CPC ..... B26D 5/00; B26D 5/005; B26D 5/007; B26D 5/02–18; B26D 1/12; B26D 1/25; B26D 1/28–285; B31B 50/14; B31B 50/20; B31B 50/22; B31B 2120/70

See application file for complete search history.

(56) References Cited

U.S. PATENT DOCUMENTS 4,649,782 A * 3/1987 Cavagna ..... B26D 5/04 83/499
6,690,990 B1 * 2/2004 Caron ..... G06Q 10/04 700/171
7,470,062 B2 * 12/2008 Moteki ..... B65D 75/5833 229/87.05

(Continued)

FOREIGN PATENT DOCUMENTS

JP 2002-067190 A 3/2002
JP 2009-291992 A 12/2009

(Continued)

*Primary Examiner* — Adam J Eiseman
*Assistant Examiner* — Richard D Crosby, Jr.
(74) *Attorney, Agent, or Firm* — Crowell & Moring LLP

(57) ABSTRACT

A machine for making corrugated paperboard boxes form corrugated paperboard sheets includes a slotter device with a blade that forms slots in the corrugated paperboard sheet. The machine can handle various sizes and configurations of corrugated paperboard sheets and can determine if the blade of the slotter device has a suitable length to form slots in each of the various corrugated paperboard sheets, using parameters including a circumferential length (N) of the slotter cylinder and dimensions (E, F, G) of the corrugated paperboard sheet.

15 Claims, 17 Drawing Sheets

(56) References Cited

U.S. PATENT DOCUMENTS

| | | | | |
|---|---|---|---|---|
| 8,579,777 | B2 * | 11/2013 | Hatano | B31B 50/00 493/182 |
| 10,922,637 | B2 * | 2/2021 | Featherstone | G06Q 10/06313 |
| 11,020,929 | B2 * | 6/2021 | Takemoto | B31B 50/006 |
| 11,247,427 | B2 * | 2/2022 | Provoost | B26D 7/26 |
| 11,318,698 | B2 * | 5/2022 | Jonsson | B26D 3/14 |
| 2003/0037646 | A1 * | 2/2003 | Ito | B31F 1/20 83/13 |
| 2014/0011654 | A1 * | 1/2014 | Maeda | B23Q 15/00 493/369 |
| 2014/0121085 | A1 * | 5/2014 | Kwarta | B26F 1/20 483/31 |
| 2014/0326119 | A1 * | 11/2014 | Endoh | B26D 5/04 83/301 |
| 2015/0148210 | A1 * | 5/2015 | Sibthorpe | B41J 3/407 493/324 |
| 2018/0178478 | A1 * | 6/2018 | Kodama | B31B 50/146 |
| 2018/0345619 | A1 * | 12/2018 | Lang | B31F 1/2813 |
| 2018/0370061 | A1 * | 12/2018 | Tokumo | B31B 50/25 |
| 2019/0062085 | A1 * | 2/2019 | Nadachi | B65H 1/06 |

FOREIGN PATENT DOCUMENTS

| | | | |
|---|---|---|---|
| JP | 2016-098050 | A | 5/2016 |
| JP | 2018-103535 | A | 7/2018 |
| JP | 2018-103536 | A | 7/2018 |

* cited by examiner

FIG.12

| ORDER | PRODUCTION MODE | SECOND SLOTTER UNIT | | FIRST SLOTTER UNIT | |
|---|---|---|---|---|---|
| | | STATIONARY BLADE | DISPLACEABLE BLADE | STATIONARY BLADE | DISPLACEABLE BLADE |
| Order 1 | First Production Mode | J1 ● J2 ● B ■ | J1 — J2 — B — | J1 — J2 — B — | J1 ● J2 ● B ■ |
| Order 2 | Third Production Mode | J1 ● J2 — B ■ | J1 ● J2 — B ■ | J1 ● J2 — B ■ | J1 ● J2 — B ■ |
| Order 3 | Third Production Mode | J1 — J2 — B ■ | J1 — J2 — B ■ | J1 — J2 — B ■ | J1 — J2 — B ■ |
| Order 4 | First Production Mode | J1 ● J2 ○ B ■ | J1 — J2 — B — | J1 — J2 — B — | J1 ● J2 ○ B ■ |

CORRUGATED PAPERBOARD BOX MAKING MACHINE

RELATED APPLICATIONS

This application claims priority to Japanese Patent Application No. 2020-160850, filed on Sep. 25, 2020, the entire content of which is incorporation herein by reference.

BACKGROUND OF THE INVENTION

1. Field of the Invention

The present invention relates to a corrugated paperboard box making machine, and more particularly to a corrugated paperboard box making machine equipped with a slotter device for performing slotting on a corrugated paperboard sheet.

2. Description of the Related Art

Heretofore, there has been known a corrugated paperboard box making machine which comprises a sheet feeding device for feeding out corrugated paperboard sheets one-by-one, a printing device for subjecting, to printing, each of the corrugated paperboard sheets fed out by the sheet feeding device, a slotter device for performing slotting (slot machining) on each of the corrugated paperboard sheets subjected to printing by the printing device, and a die-cutter device for performing punching on each of the corrugated paperboard sheets subjected to slotting by the slotter device.

In particular, the slotter device is typically configured to perform slotting on two areas: a downstream edge area (corresponding to a front flap portion); and an upstream edge area (corresponding to a rear flap portion), of the corrugated paperboard sheet being conveyed.

Meanwhile, during an order change period in such a corrugated paperboard box making machine, each printing unit in the printing device is subjected to printing plate replacement and ink color switching, and the slotter device and the die-cutter device are subjected, respectively, to slotter blade attaching/detaching (e.g., joint blade attaching/detaching) and punching wooden die replacement, depending on product specifications of a corrugated paperboard box to be produced in the next order, in some cases. In this situation, the slotter device is required to perform the slotter blade attaching/detaching so as to use a slotter blade having a length suitable for the next order (see, for example, the below-mentioned Patent Document 1: JP-A 2018-103535).

Specifically, in the Patent Document 1, there is described a technique in which, when the length of the slotter blade is shorter than a length by which a corrugated paperboard sheet needs to be slotted, i.e., a dimension of a flap portion of the corrugated paperboard sheet (each dimension of the front flap and the rear flap; hereinafter referred to appropriately as "flap dimension"), it is judged that a corrugated paperboard sheet in the next order cannot be processed by a currently-attached slotter blade, and an alarm indicating that it is necessary to attach a joint blade to the slotter blade is displayed. This technique allows a worker (operator) to easily figure out that there is a need to attach a joint blade during the order change period, thereby making it possible to prevent a situation where defective processing of corrugated paperboard sheets occurs due to forgetting to attach a joint blade.

SUMMARY OF THE INVENTION

Technical Problem

However, in the technique described in the Patent Document 1, only the determination as to whether or not the length of the slotter blade is insufficiently short (this determination will hereinafter be referred to appropriately as "insufficiency determination") is performed, but determination as to whether or not the length of the slotter blade is excessive (this determination will hereinafter be referred to appropriately as "excess determination") is not performed. In the former insufficiency determination in regard to the slotter blade length, it is only necessary to determine whether or not the length of the slotter blade is shorter than the flap dimension, from a viewpoint of allowing the entire flap portion of a corrugated paperboard sheet to be reliably cut by the slotter blade. In this case, what is required is only a simple comparison between the length of the slotter blade and the flap dimension, so that an operator can perform the determination by himself/herself.

On the other hand, the excess determination in regard to the slotter blade length requires considering more complicated conditions than the insufficiency determination in regard to the slotter blade length. Thus, it can be said that an operator has difficulty in accurately performing the determination by himself/herself (in other words, an operator needs to take a lot of time for accurately performing the determination). This is because, if the slotter blade is excessively long, various problems as mentioned below are likely to occur. Therefore, with a focus on a plurality of problems which are likely to occur due to an excessive length of the slotter blade, the present inventors thought of performing the excess determination in regard to the slotter blade length, by using a given condition for preventing the occurrence of the plurality of problems.

First, if the slotter blade is excessively long, such a slotter blade is likely to simultaneously cut two corrugated paperboard sheets adjacent to each other in a conveyance direction. Second, in a given production mode ("single slotter mode" described in the Patent Document 1) in which two corrugated paperboard sheets are fed while each of two slotters is rotated 360 degrees, and subjected to slotting by two sets of slotter blades attached to each of a first slotter unit and a second slotter unit of the slotter device, if each of the slotter blades is excessively long, the two sets of slotter blades of each of the slotter units can come into interference (i.e., contact) with each other on the outer periphery of the slotter. Third, in the single slotter mode, if each of the slotter blades is excessively long, the slotter blades can cut a glue portion located between the front flap and the rear flap in each of the corrugated paperboard sheets.

In view of the above, the present inventors thought of performing the excess determination in regard to the slotter blade length in such a manner as to satisfy a given condition determined from dimensions (flap dimension, etc.) of a corrugated paperboard box to be produced by the corrugated paperboard box making machine, and a production mode set in the slotter device, and more specifically thought of determining whether or not the length of the slotter blade is longer than a limit value for satisfying the given condition.

The present invention has been made to solve the above-mentioned problems, and an object thereof is to provide a corrugated paperboard box making machine capable of accurately performing an excess determination in regard to the length of a slotter blade of a slotter device, based on a given condition, thereby preventing problems which would otherwise occur when the slotter blade is excessively long.

Solution to Problem

In order to achieve the above object, the present invention provides a corrugated paperboard box making machine which comprises: a slotter device comprising a rotatable cylindrical-shaped slotter, and a slotter blade detachably attached onto an outer periphery of the slotter, wherein the slotter device is configured to perform slotting on a corrugated paperboard sheet by the slotter blade; and a control device configured to control at least the slotter device, wherein the control device is configured to set a limit value of a length of the slotter blade for satisfying a given condition determined from a perimeter of the slotter, dimensions of a corrugated paperboard box to be produced by the corrugated paperboard box making machine, and a production mode to be set to operate the slotter device in conformity to the box to be produced, and determine whether or not a length of a given slotter blade to be attached to the slotter device exceeds the limit value.

In the present invention having the above feature, the control device operates to set the limit value according to the given condition determined from the perimeter of the slotter, the dimensions of the box and the production mode to be set to operate the slotter device, and determine whether or not the length of the given slotter blade exceeds the limit value (perform excess determination). This makes it possible to accurately perform the excess determination in regard to the length of the slotter blade, thereby preventing problems which would otherwise occur when the slotter blade is excessively long.

Preferably, in the corrugated paperboard box making machine of the present invention, the control device is configured to set the limit value by using, as the given condition, a condition that the slotter device does not simultaneously perform slotting on two corrugated paperboard sheets adjacent to each other in a conveyance direction thereof.

According to this feature, it is possible to reliably prevent a situation where, due to an excessive length of the slotter blade, the slotter device simultaneously cuts slots in two corrugated paperboard sheets adjacent to each other in the conveyance direction.

Preferably, in the corrugated paperboard box making machine of the present invention, the slotter device comprises a first slotter unit and a second slotter unit which are arranged side-by-side in a conveyance direction of the corrugated paperboard sheet and each of which has the slotter and two sets of the slotter blades, wherein the first and second slotter units are operable in a given production mode in which two corrugated paperboard sheets are fed while the slotter makes one revolution (i.e., rotates 360 degrees), and slotting for each of the two corrugated paperboard sheets is performed by a respective one of the first and second slotter units, wherein the control device is configured to set the limit value by using, as the given condition, a condition that, in the given production mode, the two sets of slotter blades do not come into interference with each other on an outer periphery of the slotter.

According to this feature, it is possible to reliably prevent a situation where, due to an excessive length of the slotter blade, the two sets of slotter blades attached to the slotter come into interference (i.e., contact) with each other on the outer periphery of the slotter.

Preferably, in the corrugated paperboard box making machine of the present invention, the slotter device comprises a first slotter unit and a second slotter unit which are arranged side-by-side in a conveyance direction of the corrugated paperboard sheet and each of which has the slotter and two sets of the slotter blades, wherein the first and second slotter units are operable in a given production mode in which two corrugated paperboard sheets are fed while the slotter makes one revolution, and slotting for each of the two corrugated paperboard sheets is performed by a respective one of the first and second slotter units, wherein the control device is configured to set the limit value by using, as the given condition, a condition that, in the given production mode, the slotter device does not perform slotting on a glue portion located between a front flap and a rear flap in the corrugated paperboard sheet.

According to this feature, it is possible to reliably prevent a situation where, due to an excessive length of the slotter blade, the slotter device cuts the glue portion of the corrugated paperboard sheet.

Preferably, in the corrugated paperboard box making machine of the present invention, the slotter device comprises a first slotter unit and a second slotter unit which are arranged side-by-side in a conveyance direction of the corrugated paperboard sheet and each of which has the slotter and one set of the slotter blades, wherein the first and second slotter units are operable in a given production mode in which one corrugated paperboard sheet is fed while the slotter makes one revolution, and slotting for the one corrugated paperboard sheet is performed by both the first and second slotter units, wherein the control device is configured to, by using, as the given condition, a condition that, in the given production mode, the slotter device does not simultaneously perform slotting on two corrugated paperboard sheets adjacent to each other in the conveyance direction, and based on a front flap dimension E, a box depth dimension F and a rear flap dimension G of the box to be produced from the corrugated paperboard sheet, the perimeter N of the slotter, and a given margin value O, set the limit value to a value derived from "N−E−F−O" or "N−G−F−O", and determine whether or not a circumferential length of a cutting part of the given slotter blade exceeds the limit value.

According to this feature, in the above production mode (corresponding to a normal production in a so-called double slotter mode), the excess determination in regard to the length of the slotter blade can be accurately performed, so that it is possible to reliably prevent a situation where, due to an excessive length of the slotter blade, the slotter device simultaneously cuts slots in two corrugated paperboard sheets adjacent to each other in the conveyance direction.

Preferably, in the corrugated paperboard box making machine of the present invention, the slotter device comprises a first slotter unit and a second slotter unit which are arranged side-by-side in a conveyance direction of the corrugated paperboard sheet and each of which has the slotter and one set of the slotter blades, wherein the first and second slotter units are operable in a given production mode in which one corrugated paperboard sheet is fed while the slotter makes two revolutions (i.e., rotates 720 degrees), and slotting for the one corrugated paperboard sheet is performed by both the first and second slotter units, and wherein the control device is configured to, by using, as the given condition, a condition that, in the given production mode, the slotter device does not simultaneously perform slotting on two corrugated paperboard sheets adjacent to each other in the conveyance direction, and based on a front flap dimension E, a box depth dimension F and a rear flap dimension G of the box to be produced from the corrugated paperboard sheet, the perimeter N of the slotter, and a given margin value O, set the limit value to a value derived from "2N−E−F−O" or "2N−G−F−O", and determine whether or not a circumferential length of a cutting part of the given slotter blade exceeds the limit value.

According to this feature, in the above production mode (corresponding to a so-called skip-feed production in the double slotter mode), the excess determination in regard to the length of the slotter blade can be accurately performed, so that it is possible to reliably prevent a situation where, due to an excessive length of the slotter blade, the slotter device simultaneously cuts slots in two corrugated paperboard sheets adjacent to each other in the conveyance direction.

Preferably, in the corrugated paperboard box making machine of the present invention, the slotter device comprises a first slotter unit and a second slotter unit which are arranged side-by-side in a conveyance direction of the corrugated paperboard sheet and each of which has the slotter and two sets of the slotter blades, wherein the first and second slotter units are operable in a given production mode in which two corrugated paperboard sheets are fed while the slotter makes one revolution, and slotting for each of the two corrugated paperboard sheets is performed by a respective one of the first and second slotter units, and wherein the control device is configured to: (1) by using, as the given condition, a condition that, in the given production mode, the slotter device does not simultaneously perform slotting on two corrugated paperboard sheets adjacent to each other in the conveyance direction, and based on a front flap dimension E, a box depth dimension F and a rear flap dimension G of the box to be produced from the corrugated paperboard sheet, the perimeter N of the slotter, and a given margin value O, set the limit value to a value derived from "N/2−E−F−O" or "N/2−G−F−O", and determine whether or not a circumferential length of a cutting part of the given slotter blade exceeds the limit value; and (2) further, by using, as the given condition, a condition that, in the given production mode, the two sets of slotter blades do not come into interference with each other on an outer periphery of the slotter, and based on the perimeter N of the slotter, the box depth dimension F and a given margin value Z, set the limit value to a value derived from "(N−F−Z)/2", and determine whether or not an overall circumferential length of the given slotter blade exceeds the limit value.

According to this feature, in the above production mode (corresponding to one type of single slotter mode for so-called two-up production), the excess determination in regard to the length of the slotter blade can be accurately performed, so that it is possible to reliably prevent a situation where, due to an excessive length of the slotter blade, the slotter device simultaneously cuts slots in two corrugated paperboard sheets adjacent to each other in the conveyance direction, and the two sets of slotter blades come into interference with each other on the outer periphery of the slotter, Preferably, in the corrugated paperboard box making machine of the present invention, the slotter device comprises a first slotter unit and a second slotter unit which are arranged side-by-side in a conveyance direction of the corrugated paperboard sheet and each of which has the slotter and two sets of the slotter blades, wherein the first and second slotter units are operable in a given production mode in which one corrugated paperboard sheet consisting of two corrugated paperboard sheet elements to be cut into front and rear parts by a die-cutter device disposed downstream of the slotter device is fed while the slotter makes one revolution, and slotting for each of the two corrugated paperboard sheet elements comprised in the one corrugated paperboard sheet is performed by a respective one of the first and second slotter units, and wherein the control device is configured to: (1) by using, as the given condition, a condition that, in the given production mode, the slotter device does not simultaneously perform slotting on two corrugated paperboard sheets adjacent to each other in the conveyance direction, and based on a front flap dimension E, a box depth dimension F and a rear flap dimension G of the box to be produced from the corrugated paperboard sheet, the perimeter N of the slotter, and a given margin value O, set the limit value to a value derived from "N−E−2F−2G−O" or "N−2E−2F−G−O", and determine whether or not a circumferential length of a cutting part of the given slotter blade exceeds the limit value; (2) further, by using, as the given condition, a condition that, in the given production mode, the two sets of slotter blades do not come into interference with each other on an outer periphery of the slotter, and based on the perimeter N of the slotter, the box depth dimension F and a given margin value Z, set the limit value to a value derived from "(N−F−Z)/2", and determine whether or not an overall circumferential length of the given slotter blade exceeds the limit value; and (3) further, by using, as the given condition, a condition that, in the given production mode, the slotter device does not perform slotting on a glue portion located between a front flap and a rear flap in the corrugated paperboard sheet, and based on the front flap dimension E, the rear flap dimension G and a given margin value Q, set the limit value to a value derived from "E+G−Q", and determine whether or not the circumferential length of the cutting part of the given slotter blade exceeds the limit value.

According to this feature, in the above production mode (corresponding to another type of single slotter mode for the so-called two-up production), the excess determination in regard to the length of the slotter blade can be accurately performed, so that it is possible to reliably prevent a situation where, due to an excessive length of the slotter blade, the slotter device simultaneously cuts slots in two corrugated paperboard sheets adjacent to each other in the conveyance direction; the two sets of slotter blades come into interference with each other on the outer periphery of the slotter; and the slotter device cuts the glue portion.

Preferably, the corrugated paperboard box making machine of the present invention further comprises a display device, wherein the control device is configured to, upon determining that the length of the given slotter blade exceeds the limit value, cause the display device to display the fact thereon.

According to this feature, an operator can easily know through sight that the slotter blade is evasively long.

Preferably, in the corrugated paperboard box making machine of the present invention, the control device is configured to: based on dimensions of a corrugated paperboard box to be produced according to each of a plurality of orders, and a production mode to be set in each of the plurality of orders, set the limit value to be used in each of the plurality of orders; determine, with respect to each of the plurality of orders, whether or not the length of the given slotter blade exceeds the limit value, by using, as the length of the given slotter blade, a length determined by a given basic blade and joint blade combination to be attached to the slotter device; and further determine, with respect to each of the plurality of orders, whether or not the basic blade and/or the joint blade need to be detached from the given basic blade and joint blade combination, according to a result of the determination as to whether or not the length of the given slotter blade exceeds the limit value.

According to this feature, with respect to each of the plurality of orders, it is possible to accurately perform the excess determination in regard to the length of the slotter blade, and accurately perform determination as to whether or not the slotter blade (basic blade and/or joint blade) needs to be detached.

More preferably, the above corrugated paperboard box making machine further comprises a display device, wherein the control device is configured to cause the display device to display thereon a result of the determination, with respect to each of the plurality of orders, as to whether or not the basic blade and/or the joint blade need to be detached from the given basic blade and joint blade combination, in the form of a list.

According to this feature, with respect to each of the plurality of orders, an operator can easily figure out through sight whether or not the slotter blade needs to be detached.

Preferably, the corrugated paperboard box making machine of the present invention comprises a plurality of processing devices including the slotter device, wherein the control device is configured to employ, as the length of the given slotter blade, a length of a slotter blade currently attached to the slotter device, and, upon determining that the length of the currently-attached slotter blade exceeds the limit value, perform, prior to production of a next order, control of widening an interval between the slotter device and a processing device adjacent thereto among the plurality of processing devices.

According to this feature, it is possible to quickly ensure a space for performing a slotter blade attaching/detaching operation, prior to production of the next order (specifically, during an order change period after completion of a previous order through until the next order is started).

More preferably, in the corrugated paperboard box making machine of the present invention, the plurality of processing devices include, in order from an upstream side in a conveyance direction of the corrugated paperboard sheet: a printing device comprising two or more printing units each for subjecting the corrugated paperboard sheet to printing; a creaser device for subjecting the resulting corrugated paperboard sheet to creasing; the slotter device; and a die-cutter device for subjecting the resulting corrugated paperboard sheet to punching, wherein the control device is configured to switch between control of widening only an interval between the slotter device and the die-cutter device, and control of widening both the interval between the slotter device and the die-cutter device and an interval between the slotter device and the creaser device, depending on a number of printing units whose printing plates need to be replaced for production of a next order, among the two or more printing units.

According to this feature, an interval between the slotter device and an adjacent one of the processing devices can be maximally widened, depending on the number of printing units whose printing plates need to be replaced, i.e., according to a condition for the printing units to widen an interval therebetween.

Preferably, in the corrugated paperboard box making machine of the present invention, the slotter device further comprises a second slotter to which a second slotter blade engageable with the aforesaid, first slotter blade is attached and which is disposed beneath the aforesaid, first slotter, wherein the slotter device comprises a plurality of sets of the first and second slotters, arranged in a direction orthogonal to a conveyance direction of the corrugated paperboard sheet, wherein the control device is configured to employ, as the length of the given slotter blade, a length of a slotter blade currently attached to the slotter device, and, upon determining that the length of the currently-attached slotter blade exceeds the limit value, perform, prior to production of a next order, control of positioning the plurality of sets of the first and second slotters at even intervals in the direction orthogonal to the conveyance direction, and/or control of circumferentially positioning the first slotter blade so as to prevent the first slotter blade from engaging with the second slotter blade.

According to this feature, it is possible to, prior to production of the next order (specifically, during the order change period), position the plurality of sets of the first and second slotters at even intervals in the direction orthogonal to the conveyance direction, thereby adequately ensuring the space for performing the slotter blade attaching/detaching operation, and circumferentially position the first slotter blade so as to prevent engagement between the first and second (upper and lower) slotter blades, thereby allowing an operator to quickly start the slotter blade attaching/detaching operation.

Preferably, in the corrugated paperboard box making machine of the present invention, the control device is configured to further determine whether or not the length of the given slotter blade is insufficient with respect to a length by which the corrugated paperboard sheet needs to be slotted.

According to this feature, it is possible to prevent defective processing which would otherwise occur when the length of the slotter blade is insufficiently short.

The corrugated paperboard box making machine of the present invention makes it possible to accurately perform the excess determination in regard to the length of the slotter blade of the slotter device, based on a given condition, thereby preventing problems which would otherwise occur when the slotter blade is excessively long.

BRIEF DESCRIPTION OF THE DRAWINGS

FIG. 12 illustrates an example of a display screen on a display device connected to an upper-level management device, according to excess determination and insufficiency determination in regard to the length of the slotter blade in this embodiment.

DETAILED DESCRIPTION OF THE PREFERRED EMBODIMENTS

With reference to the accompanying drawings, a corrugated paperboard box making machine of the present invention will now be described based on one embodiment thereof.

<General Configuration>

Figure 1:
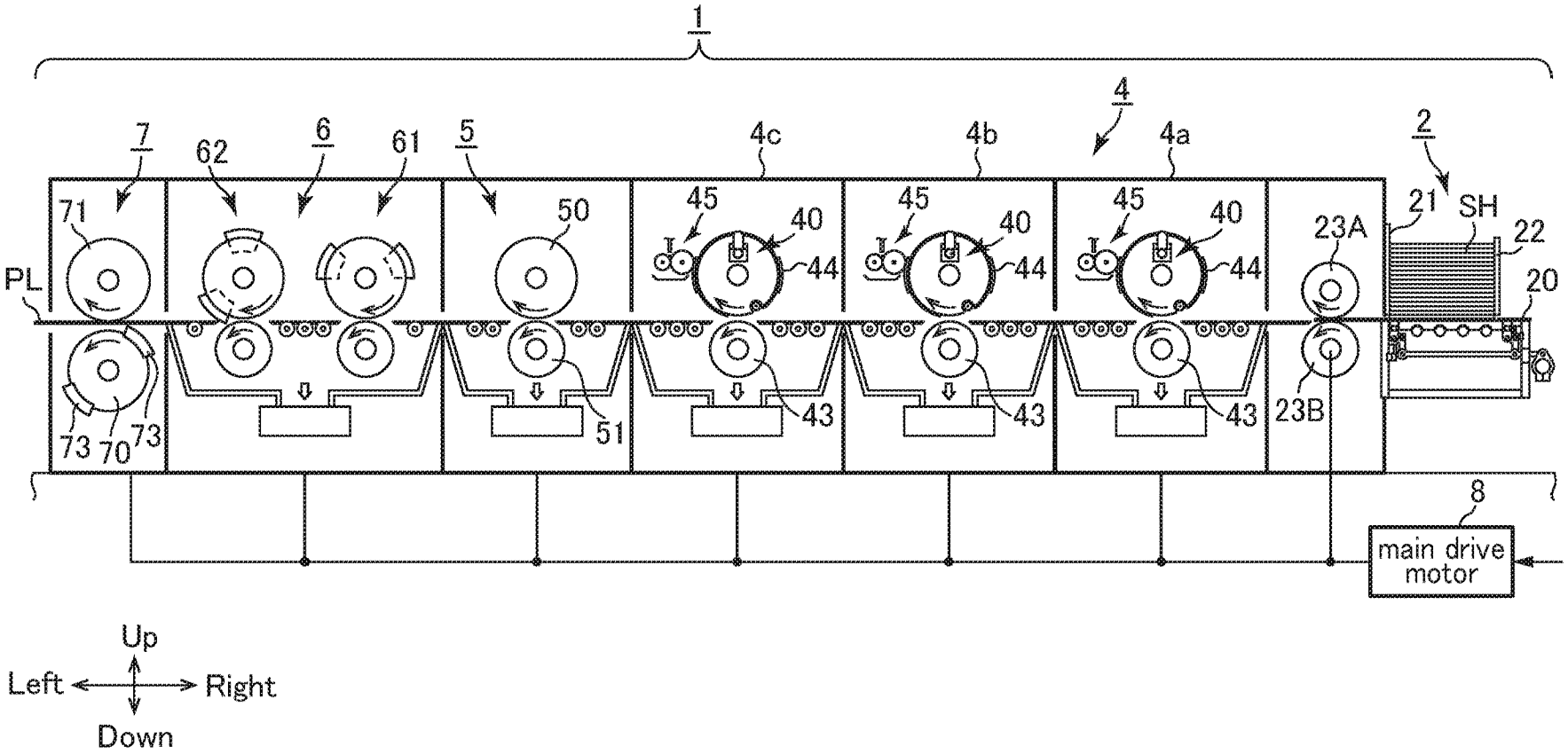
FIG. 1 is a front view showing the overall configuration of a corrugated paperboard box making machine according to one embodiment of the present invention.

First of all, with reference to FIG. 1, a general configuration of a corrugated paperboard box making machine 1 according to one embodiment of the present invention will be described. FIG. 1 is a front view showing the general configuration of the corrugated paperboard box making machine 1 according to this embodiment.

As shown in FIG. 1, the corrugated paperboard box making machine 1 comprises; a sheet feeding device 2 for feeding out a plurality of corrugated paperboard sheets SH stacked in an up-down direction, one-by-one; a printing device 4 for sequentially subjecting the corrugated paperboard sheets SH to printing; a creaser device 5 for sequentially subjecting the resulting corrugated paperboard sheets SH to ceasing; a slotter device 6 for sequentially subjecting the resulting corrugated paperboard sheets SH to slotting (slot machining); and a die-cutter device 7 for sequentially subjecting the resulting corrugated paperboard sheets SH to punching, which are arranged in this order from the side of an upstream end of a conveyance path PL for the corrugated paperboard sheets SH (a conveyance direction of the corrugated paperboard sheets SH is a direction directed from the right side to the left side in FIG. 1).

The sheet feeding device 2 comprises a table 20, a front gate 21 and a back guide 22, wherein a large number of corrugated paperboard sheets SH are stacked on the table 20 in a space between the front gate 21 and the back guide 22. The sheet feeding device 2 further comprises a large number of sheet feeding rollers, a liftable-lowerable grate, and a pair of feed rolls 23A, 23B. When the grate is lowered with respect to the large number of sheet feeding rollers, the large number of sheet feeding rollers are brought into contact with a lowermost one of the large number of corrugated paperboard sheets SH, thereby feeding out the corrugated paperboard sheets SH one-by-one toward the feed rolls 23A, 23B. The feed rolls 23A, 23B are driven by a main drive motor 8.

The printing device 4 comprises three printing units 4*a*, 4*b*, 4*c*. Each of the printing units 4*a*, 4*b*, 4*c* comprises: a printing cylinder 40, so-called "impression cylinder"; a press roll 43 disposed at a position opposed to the printing cylinder 4 across the conveyance path PL; a printing plate 44 for printing a pattern on the corrugated paperboard sheet SH; and an ink applicator 45 for supplying ink to the printing plate 44. The ink applicator 45 comprises an inking roll for inking a color, wherein the color is different in each of the printing units 4*a*, 4*b*, 4*c*, so that the printing device 4 can print a three-color patter on the corrugated paperboard sheet SH by the printing units 4*a*, 4*b*, 4*c*. The printing cylinder 40 and the press roll 43 are driven by the main drive motor 8. It should be noted that the printing device 4 is not limited to be composed of the three printing units 4*a*, 4*b*, 4*c*, but may be composed of two or less printing units, or may be composed of four or more printing units.

The creaser device 5 comprises an upper creasing roll 50 and a lower creasing roll 51 which are arranged across the conveyance path PL. The upper and lower creasing rolls 50, 51 are configured to form a crease line at a desired position of the corrugated paperboard sheet SH being conveyed. The upper and lower creasing rolls 50, 51 are driven by the main drive motor 8.

The slotter device 6 comprises two slotter units: a first slotter unit 61; and a second slotter unit 62. Each of the first and second slotter units 61, 62 comprises; an upper slotter to which two sets of slotter blades are attached; and a lower slotter formed with a groove capable of fittingly receiving the slotter blades therein, wherein the upper and lower slotters are arranged across the conveyance path PL. The upper and lower slotters are configured to cut a slot at a desired position of the corrugated paperboard sheet SH being conveyed. The upper and lower slotters are driven by the main drive motor 8.

The die-cutter device 7 comprises a die cylinder 70 and an anvil cylinder 71 which are arranged across the conveyance path PL. A pair of punching dies 73 each for punching the corrugated paperboard sheet SH is attached to a plate-shaped member such as a veneer board, and then the plate-shaped member is wrappingly attached to an outer peripheral surface of the die cylinder 70. Each of the punching dies 73 is configured to punch out part of the corrugated paperboard sheet SH being continuously conveyed, at a desired position. The die cylinder 70 and the anvil cylinder 71 are driven by the main drive motor 8.

<Configuration of Slotter Device>

Figure 2:
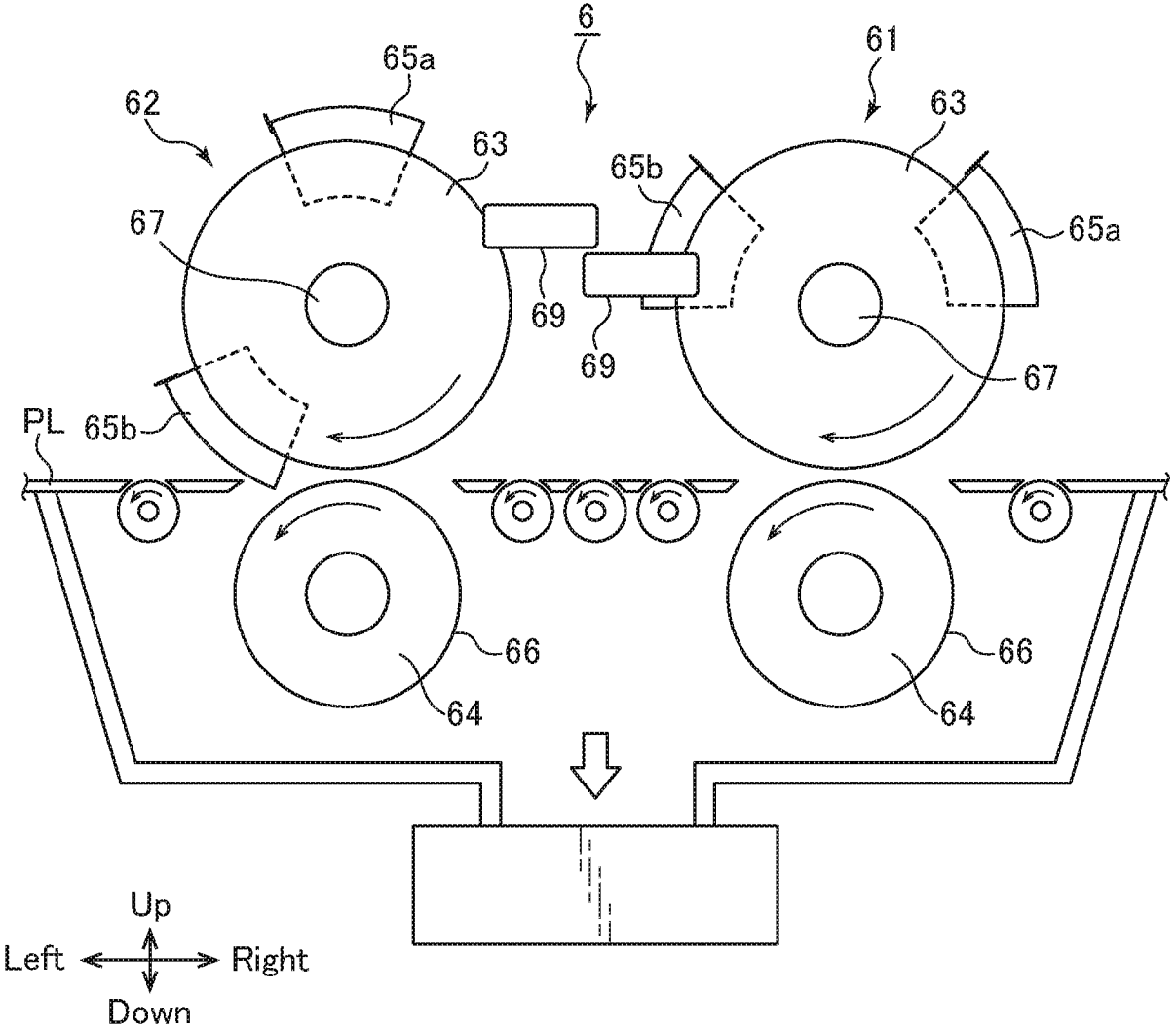
FIG. 2 is a front view enlarged showing a detailed configuration of first and second slotter units of a slotter device in this embodiment.

Next, with reference to FIG. 2, a specific configuration of the slotter device 6 according to this embodiment will be described. FIG. 2 is a front view enlarged showing a detailed configuration of the first and second slotter units 61, 62 of the slotter device 6 in this embodiment.

In FIG. 2, the slotter device 6 comprises the first slotter unit 61 and the second slotter unit 62 which are disposed, respectively, on an upstream side and on a downstream side along the conveyance path PL. Each of the first and second slotter units 61, 62 comprises: a slotting slotter set composed of an upper slotter 63 and a lower slotter 64, which are rotatable cylindrical-shaped slotters, arranged across the conveyance path PL, and provided, e.g., by a number of three, in a direction orthogonal to the conveyance path PL; and a heretofore-known joint flap-forming slotter set provided, e.g., by a number of one, in the orthogonal direction. Each of the upper and lower slotters 63, 64 is coupled to the main drive motor 8 via a heretofore-known power transmission mechanism, and configured to be rotated in a direction indicated by the arrowed line in FIG. 2, according to rotation of the main drive motor 8.

The upper slotter 63 is provided with: a stationary slotter blade 65*a* which is fixed onto an outer periphery of the upper slotter 65*a*, and equipped with a chisel at an edge thereof on a leading side in a direction opposite to a rotational direction of the upper slotter 63; and a displaceable slotter blade 65*b* which is installed on the outer periphery of the upper slotter 63 displaceably in a circumferential direction of the upper slotter 63, and equipped with a chisel at an edge thereof on a leading side in the rotational direction. Each of the stationary slotter blade 65*a* and the displaceable slotter blade 65*b* is configured to be attachable and detachable with respect to the upper slotter 63. Further, the upper slotter 63 is rotatably supported by a frame of the slotter device 6 through a slotter shaft 67. The lower slotter 64 is rotatably supported by the frame of the slotter device 6, and configured such that it has an outer periphery entirely formed as a slotter blade 66.

It should be noted that, in the following description, when each of the stationary slotter blade 65*a* and the displaceable slotter blade 65*b* is used without distinction therebetween, it will be expressed simply as "slotter blade 65". Further, the stationary slotter blade will be occasionally expressed simply as "stationary blade", and the displaceable slotter blade will be occasionally expressed simply as "displaceable blade". Basically, a slotter blade 65 (the stationary blade 65*a* or the displaceable blade 65*b*) is composed of one set (assembly) of blades in which one or more joint blades are coupled to one basic blade provided with a chisel at an edge thereof. However, in some cases, the slotter blade 65 is composed of only the basic blade.

Two position sensors 69 are provided between the first slotter unit 61 and the second slotter unit 62. The position sensors 69 are arranged staggered in the up-down direction, and fixed to the frame of the slotter device 6. Each of the position sensors 69 is configured to be capable of detecting the stationary blade 65*a* and the displaceable blade 65*b*. For example, a proximity sensor capable of detecting metal is employed as each of the position sensors 69, wherein the position sensor 69 is turned on when the slotter blade 65 is located adjacent thereto.

<Electrical Configuration>

Next, with reference to FIG. 3, an electrical configuration of the corrugated paperboard box making machine 1 according to this embodiment will be described.

Figure 3:
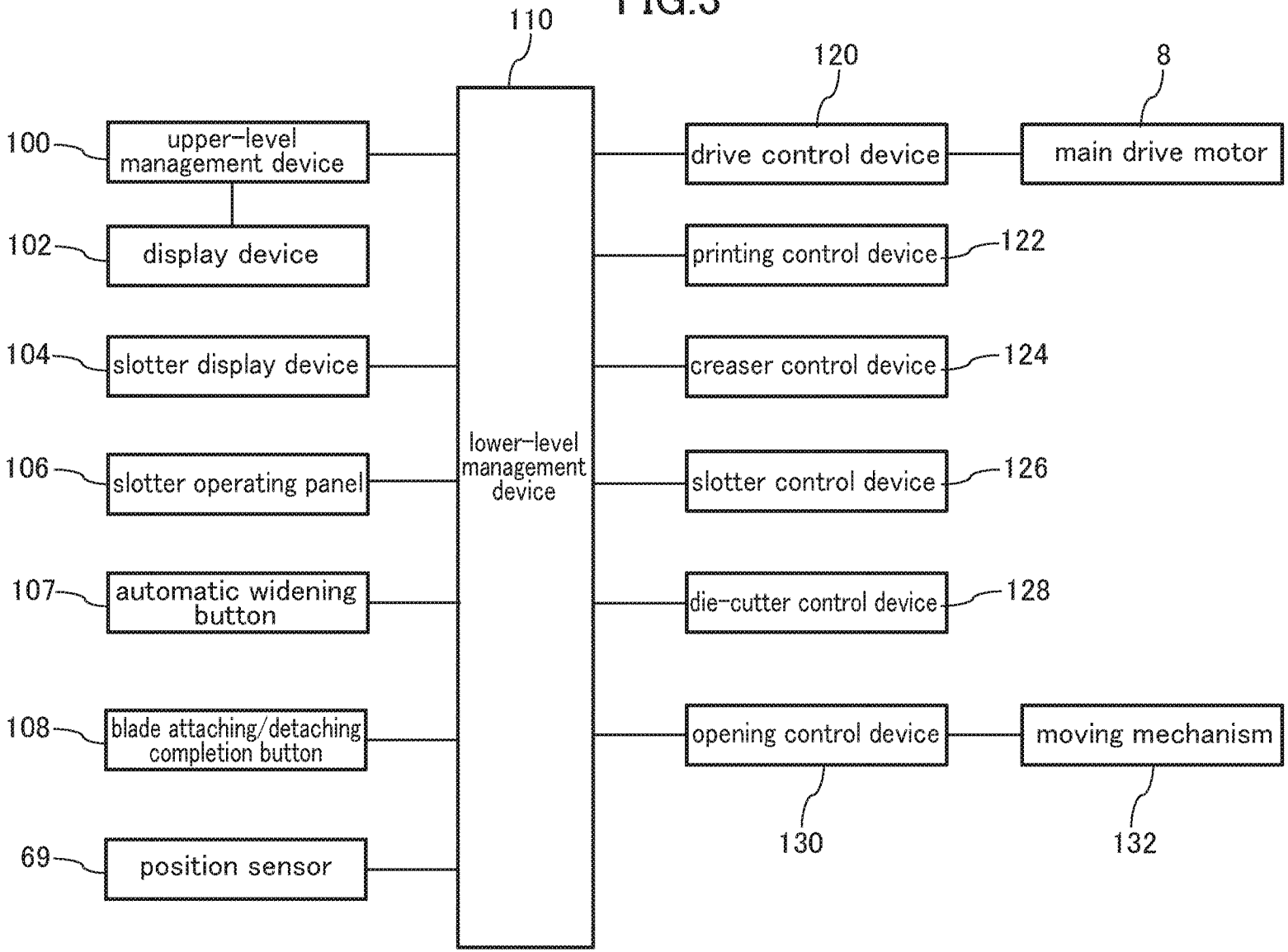
FIG. 3 is a block diagram showing an electrical configuration of the corrugated paperboard box making machine according to this embodiment.

FIG. 3 is a block diagram showing the electrical configuration of the corrugated paperboard box making machine 1 according to this embodiment.

An upper-level management device 100 and a lower-level management device 110 are provided as the means to generally manage processing of corrugated paperboard sheets SH in the corrugated paperboard box making machine 1. The upper-level management device 100 stores therein information about a plurality of orders to be executed in a predetermined sequence (i.e. production management plan), etc. The upper-level management device 100 is configured to, in each order, send, to the lower-level management device 110, control instruction information regarding a sheet conveyance speed, dimensions of a corrugated paperboard sheet SH (including dimensions of a corrugated paperboard box to be formed by the corrugated paperboard sheet SH), a production mode, the number or amount of corrugated paperboard sheets SH to be processed, etc. Further, the upper-level management device 100 is connected to a display device 102 for displaying thereon a variety of information. On the other hand, the lower-level management device 110 is a device configured to control operations of drive sections such as the main drive motor 8, according to the control instruction information sent from the upper-level management device 100, and perform management control, e.g., of counting the number or amount of processed corrugated paperboard sheets SH and sending the obtained data to the upper-level management device 100. Here, the upper-level management device 100 and/or the lower-level management device 110 correspond to one example of "control device" set forth in the appended claims.

Specifically, a slotter display device 104 provided in the slotter device 6, and a slotter operation panel 106 as a touch panel provided in the slotter display device 104, are connected to the lower-level management device 110. The slotter display device 104 is configured to display thereon a current production speed, a current sheet feed count, etc., and the slotter operating panel 106 is configured to allow a worker (operator) to enter therethrough information about a slotter blade 65 currently attached to the slotter device 6 (e.g., information about respective dimensions of the basic blade and the joint blade).

It should be noted that the slotter display device 104 is actually configured to further display thereon information about processing devices other than the slotter device 6 in the corrugated paperboard box making machine 1, specifically the sheet feeding device 2, the printing device 4, the creaser device 5 and the die-cutter device 7. That is, the slotter display device 104 is a display device shared used by these processing devices. In this specification, display of information related to the slotter device 6 will be mainly described. Thus, for convenience of explanation, a display device shared used by the processing devices of the corrugated paperboard box making machine 1 is expressed as "slotter display device 104". The slotter operating panel 106 is named for a similar reason. Specifically, since display of information related to the slotter device 6 will be mainly described in this specification, an operating panel shared used by the processing devices of the corrugated paperboard box making machine 1 is expressed as "slotter operating panel 106".

Further, an automatic widening button 107 to be manipulated by the operator so as to trigger an operation of automatically widening an interval between adjacent ones of the processing devices of the corrugated paperboard box making machine 1 (this operation will hereinafter be referred to as "open operation") is connected to the lower-level management device 110. The automatic widening button 107 is manipulated by the operator to perform: replacement of the printing plate 44 and ink color switching in the printing device 4; attaching/detaching of the slotter blade 65 (e.g., attaching/detaching of the joint blade) in the slotter device 6; and/or replacement of the punching dies 73 in the die-cutter device 7, during an order change period. Further, a blade attaching/detaching completion button 108 to be manipulated by the operator when the attaching/detaching of the slotter blade 65 in the slotter device 6 is completed, and the position sensors 69 each for detecting the position of the slotter blade 65 (each of the stationary blade 65*a* and the displaceable blade 65*b*) are connected to the lower-level management device 110.

On the other hand, the lower-level management device 110 is connected to each of a drive control device 120, a printing control device 122, a creaser control device 124, a slotter control device 126, and a die-cutter control device 128. The drive control device 120 is configured to control activation and deactivation of the main drive motor 8, and a rotational speed thereof, according to the control instruction information from the lower-level management device 110. The rotational speed of the main drive motor 8 is controlled according to the sheet conveyance speed contained in the control instruction information. The printing control device 122, the creaser control device 124, the slotter control device 126 and the die-cutter control device 128 are configured to control the printing units 4*a*, 4*b*, 4*c* of the printing device 4, the creaser device 5, the slotter device 6 and the die-cutter device 7, respectively, according to the control instruction information from the lower-level management device 110.

Further, the lower-level management device 110 is connected to an opening control device 130 for controlling an open operation for each processing device of the corrugated paperboard box making machine 1 when the automatic widening button 107 is manipulated by the operator. The opening control device 130 is connected to a moving mechanism 132 configured to be capable of moving each of the printing units 4*a*, 4*b*, 4*c*, the creaser device 5, the slotter device 6, and the die-cutter device 7. For example, the moving mechanism 132 is operable to move each of these processing devices in a direction along the conveyance direction of corrugated paperboard sheets. The opening control device 130 is configured to control the moving mechanism 132 to widen the interval between adjacent ones of the printing units 4*a*, 4*b*, 4*c*, the interval between the creaser device 5 and the slotter device 6, and/or the interval between the slotter device 6 and the die-cutter device 7, according to the control instruction information from the lower-level management device 110.

<Excess Determination in Regard to Length of Slotter Blade>

Next, excess determination in regard to the length of the slotter blade 65 in this embodiment will be described. First of all, a basic concept of the excess determination will be described. If the slotter blade 65 is excessively long, the plurality of problems is likely to occur, as mentioned in the section "Technical Problem". Therefore, with a focus on the plurality of problems which are likely to occur due to an excessive length of the slotter blade 65, the present inventors thought of performing the excess determination in regard to the length of the slotter blade 65, by using a given condition for preventing the occurrence of the plurality of problems.

The plurality of problems possibly occurring due to an excessive length of the slotter blade 65 are as follows. First, if the slotter blade 65 is excessively long, the slotter blade 65 is likely to simultaneously cut two corrugated paperboard sheets SH adjacent to each other in the conveyance direction. Second, in a production mode ("single slotter mode" described in the Patent Document 1) in which two corrugated paperboard sheets SH are fed while the upper slotter 63 is rotated 360 degrees, if the slotter blade 65 is excessively long, the stationary blade 65*a* and the displaceable blade 65*b* can come into interference (i.e., contact) with each other on the outer periphery of the upper slotter 63. Third, in the single slotter mode, if the slotter blade 65 is excessively long, the slotter blade 65 can cut a glue portion located between a front flap and a rear flap in each of the corrugated paperboard sheets SH.

In view of these problems, the present inventors thought of performing the excessive determination in regard to the length of the slotter blade 65 in such a manner as to satisfy a given condition determined from the perimeter (peripheral length) of the upper slotter 63 (which is basically identical to the perimeter of the printing cylinder 40 or the like), dimensions of a corrugated paperboard box to be produced by the corrugated paperboard box making machine 1, and a production mode to be set to operate the slotter device 6 in conformity to the box to be produced. In particular, the present inventors thought of setting a limit value of the length of the slotter blade 65 for satisfying the above given condition, and determining whether or not the length of the slotter blade 65 exceeds the limit value. This makes it possible to accurately perform the excess determination in regard to the length of the slotter blade 65 based on the given condition, thereby preventing the problems which would otherwise occur when the slotter blade 65 is excessively long.

Before explaining the content of the excess determination in this embodiment, matters as a prerequisite therefor will be described with reference to FIGS. 4, 5A and 5B.

Figure 4:
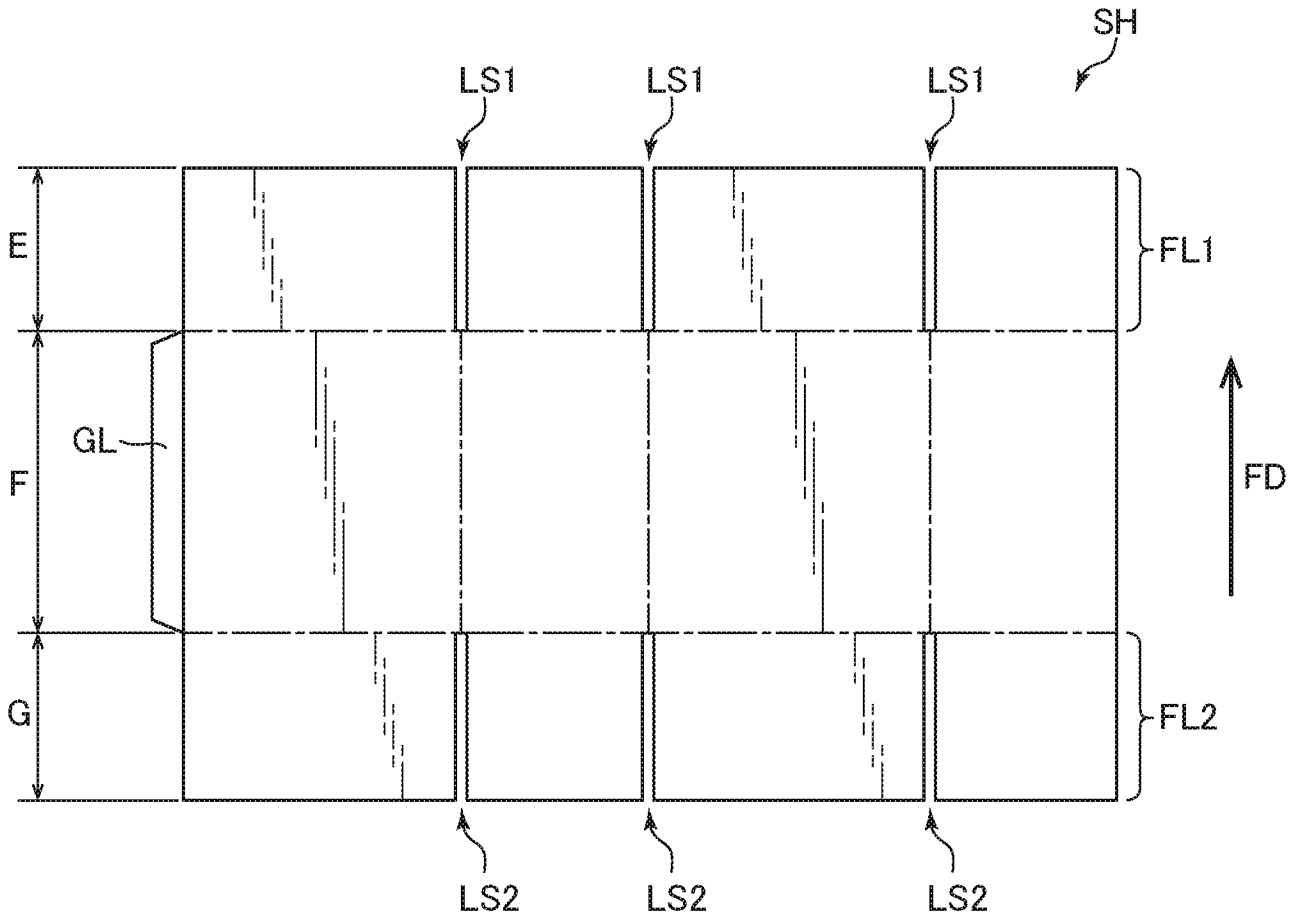
FIG. 4 is a top plan view of a corrugated paperboard sheet just after slotting.

FIG. 4 is an explanatory diagram of basic matters of slotting by the slotter device 6. FIG. 4 is a top plan view of a corrugated paperboard sheet SH just after slotting. A plurality of (three) areas each designated by the reference sign LS1 are slotted areas formed in a front flap portion FL1 of the corrugated paperboard sheet SH, through slotting by the slotter device 6. Further, a plurality of (three) areas each designated by the reference sign LS2 are slotted areas formed in a rear flap portion FL2 of the corrugated paperboard sheet SH, through slotting by the slotter device 6. Further, a portion designated by the reference sign GL (a portion protruding in a direction orthogonal to the conveyance direction FD) is a glue portion located between the front flap portion FL1 and the rear flap portion FL2. When a corrugated paperboard box is formed from the corrugated paperboard sheet SH, glue is applied to the glue portion GL to perform a bonding operation.

In the following description, the length of the front flap portion FL1, i.e., a front flap dimension, and the length of the rear flap portion FL2, i.e., a rear flap dimension, are expressed, respectively, as "E" and "G", and the length of a portion between the front flap portion FL1 and the rear flap portion FL2, i.e., a box depth dimension, is expressed as "F". Here, basically, the front flap dimension E is equal to the rear flap dimension G. However, there is a corrugated paperboard sheet SH of a type devoid of one of the front flap portion FL1 and the rear flap portion FL2. In such a corrugated paperboard sheet SH, one of the front flap dimension E and the rear flap dimension G becomes 0.

Figure 5B:
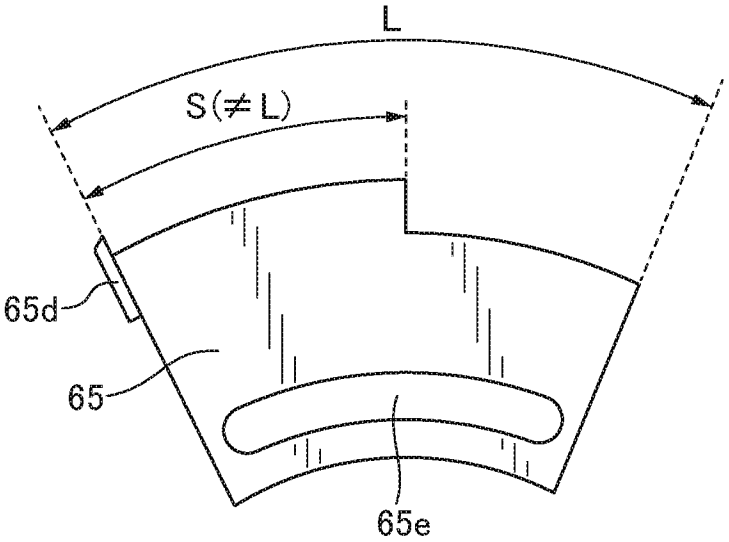
FIG. 5B is a top plan view of a slotter blade whose outermost peripheral portion is only partially formed as a cutting part.
Figure 5A:
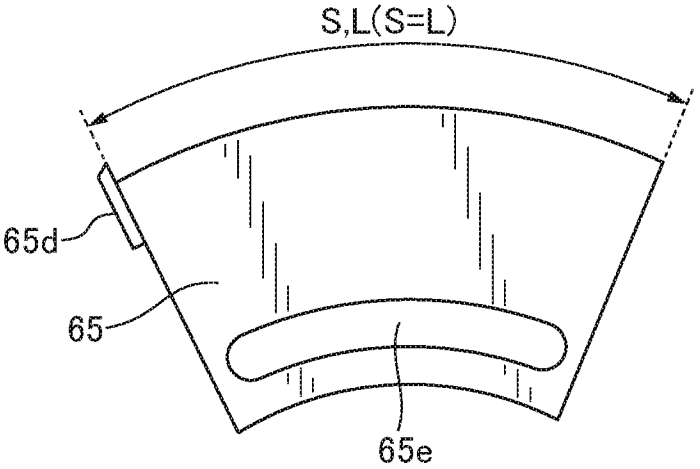
FIG. 5A is a top plan view of a slotter blade whose outermost peripheral portion is entirely formed as a cutting part.

Next, FIGS. 5A and 5B are explanatory diagramd of basic matters of the length of the slotter blade 65. FIGS. 5A and 5B are top plan views each showing one blade composing the slotter blade 65. These figures show two examples of a basic blade with a chisel 65*d*. In these figures, the reference sign 65*e* designates a bolt hole for fixing the slotter blade 65 to the upper slotter 63.

FIG. 5A shows one type of slotter blade 65 whose outermost peripheral portion (arc-shaped portion located on an outer side thereof) is entirely formed as a cutting part, and FIG. 5B shows another type of slotter blade 65 whose outermost peripheral portion is only partially formed as a cutting part. In the slotter blade 65 illustrated in FIG. 5A, when a circumferential length of the cutting part (i.e., the length of the arc-shaped portion corresponding to the cutting part; hereinafter referred to simply as "cutting part dimension") is expressed as "S", and an overall circumferential length of the slotter blade 65 (i.e., the overall length of the arc-shaped portion corresponding to the outermost peripheral portion of the slotter blade 65; hereinafter referred to simply as "blade length") is expressed as "L", the cutting part dimension S is equal to the blade length L (S=L). On the other hand, in the slotter blade 65 illustrated in FIG. 5B, the cutting part dimension S is not equal to the blade length L (S≠L). Specifically, the cutting part dimension S is shorter than the blade length L (S<L). Considering a need to form the bolt hole 65*e* to have a relatively long length in order to firmly fix the slotter blade 65 to the upper slotter 63, the slotter blade 65 whose outermost peripheral portion is only partially formed as a cutting part, as shown in FIG. 5B, is used to cut a slot having a length less than that of the bolt hole 65*e*.

Here, at the start of the after-mentioned excess determination in regard to the length of the slotter blade 65, the upper-level management device 100 or the lower-level management device 110 acquires information about the basic blade and the joint blade of the slotter blade 65. Specifically, with regard to the basic blade and the joint blade used in the slotter blade 65 (i.e., the stationary blade 65*a* and/or the displaceable blade 65*b*) of each of the first and second slotter units 61, 62, the upper-level management device 100 or the lower-level management device 110 acquires information about the above-mentioned cutting part dimension S and the blade length L, and the presence or absence of the basic blade and the joint blade. In a case where the cutting part dimension S is equal to the blade length L, only information about the cutting part dimension S may be used.

In one example, the upper-level management device 100 or the lower-level management device 110 acquires information about the basic blade and the joint blade of the slotter blade 65, based on information entered by the operator through the slotter operating panel 106. In this case, the operator enters respective dimensions of the basic blade and the joint blade by using the slotter operating panel 106, and the upper-level management device 100 or the lower-level management device 110 acquires the cutting part dimension S and the blade length L in the slotter blade 65, based on the dimensions entered in the above manner (basically, derives two lengths by summing respective values of the cutting part dimension S in the basic blade and the joint blade, and respective values of the blade length L in the basic blade and the joint blade, individually). In this regard, the slotter display device 104 may be configured to display thereon information about a plurality of preliminarily-registered basic blades and joint blades. Then, the operator may select information about the concerned basic blade and joint blade from among the displayed information, through the slotter operating panel 106.

In another embodiment, the upper-level management device 100 or the lower-level management device 110 acquires information about the basic blade and the joint blade of the slotter blade 65, specifically the cutting part dimension S and the blade length L of the slotter blade 65, based on a result of detection of the above-mentioned position sensors 69. For example, the length of the slotter blade 65 may be derived, based on a time period during which the position sensor 69 is turned on, in a situation where the upper slotter 63 is being rotated at a constant speed. Preferably, the upper-level management device 100 or the lower-level management device 110 uses a result of detection of the position sensors 69 obtained after the attaching/detaching operation for the slotter blade 65 is completed and then the operator manipulates the blade attaching/detaching completion button 108.

The given condition and the limit value used for performing the excess determination in regard to the length of the slotter blade 65, in each of various production modes in this embodiment, will be specifically described below.

(First Production Mode)

Figure 6:
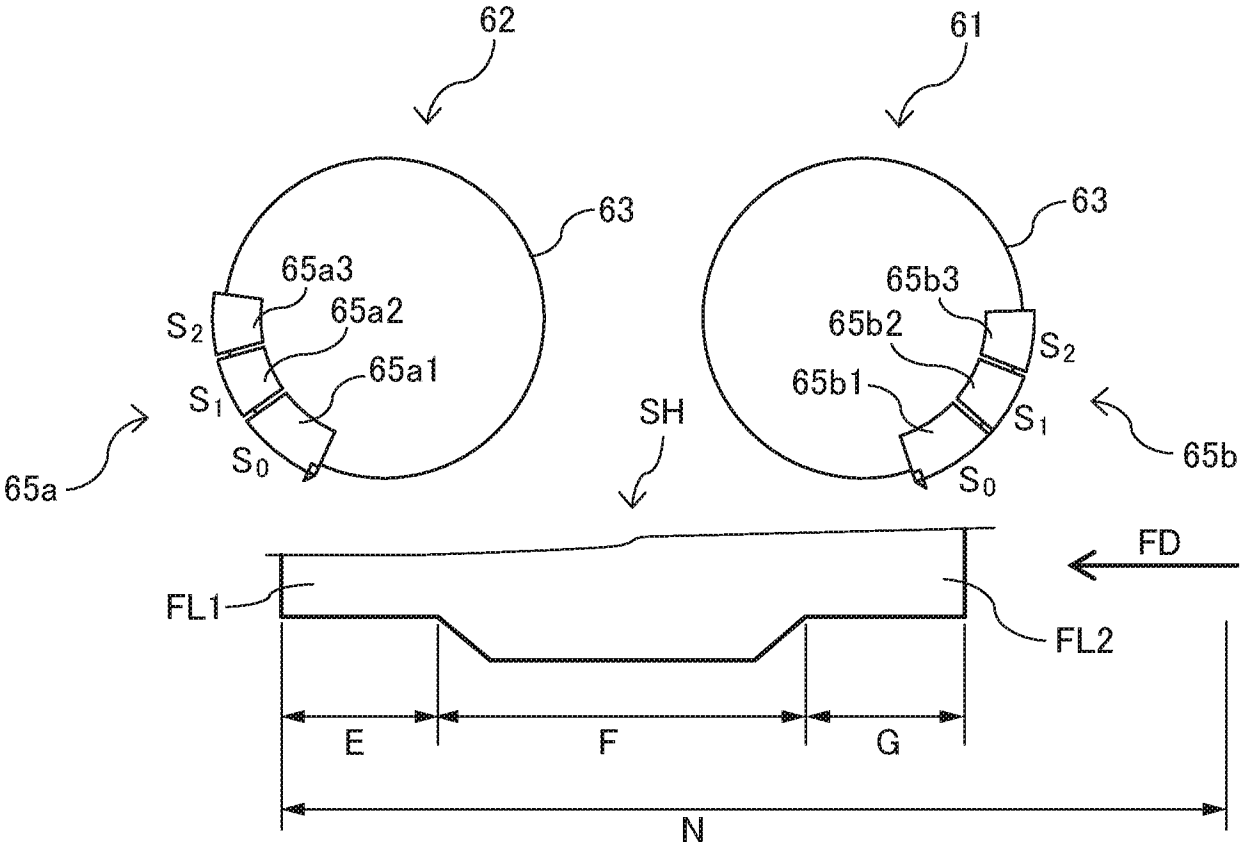
FIG. 6 is an explanatory diagram of a given condition and a limit value used in a first production mode in this embodiment.

With reference to FIG. 6, the given condition and the limit value used in a first production mode in this embodiment will be described. FIG. 6 schematically shows the first and second slotter units 61, 62 of the slotter device 6, and a corrugated paper board sheet SH to be subjected to slotting by the slotter device 6.

The first production mode is a production mode in which one corrugated paperboard sheet SH having a relatively long length in the conveyance direction is fed while the upper slotter 63 rotates 360 degrees, and slotting for the one corrugated paperboard sheet SH is performed by both the first and second slotter units 61, 62. The first production mode corresponds to a normal production in a so-called double slotter mode. In this first production mode, the first slotter unit 61 is set up such that the stationary blade 65*a* is detached, and only the displaceable blade 65*b* is attached, and the second slotter unit 62 is set up such that the displaceable blade 65*b* is detached, and only the stationary blade 65*a* is attached. In the first production mode, the front flap portion FL1 of the corrugated paperboard sheets SH is subjected to slotting by the stationary blade 65*a* of the second slotter unit 62, and the rear flap portion FL2 of the corrugated paperboard sheet SH is subjected to slotting by the displaceable blade 65*b* of the first slotter unit 61.

In another example, in the first production mode, the first slotter unit 61 may be set up such that the displaceable blade 65*b* is detached, and only the stationary blade 65*a* is attached, and the second slotter unit 62 may be set up such that the stationary blade 65*a* is detached, and only the displaceable blade 65*b* is attached. In yet another example, in the first production mode, each of the first and second slotter units 61, 62 may use an assembly of slotter blades 65 formed by coupling the stationary blade 65*a* and the displaceable blade 65*b* together.

Here, in a case where the displaceable blade 65*b* of the first slotter unit 61 comprises a basic blade 65*b*1 whose cutting part dimension is $S_0$, and two joint blades 65*b*2, 65*b*3 whose cutting part dimensions are $S_1$ and $S_2$, respectively (basically $S_1=S_2$), the cutting part dimension S of the displaceable blade 65*b* is derived as "$S=S_0+S_1+S_2$" by summing these dimensions $S_0$, $S_1$, $S_2$. Similarly, in a case where the stationary blade 65*a* of the second slotter unit 62 comprises a basic blade 65*a*1 whose cutting part dimension is $S_0$, and two joint blades 65*a*2, 65*a*3 whose cutting part dimensions are $S_1$ and $S_2$, respectively (basically $S_1=S_2$), the cutting part dimension S of the stationary blade 65*a* is derived as "$S=S_0+S_1+S_2$" by summing these dimensions $S_0$, $S_1$, $S_2$. Since the front flap dimension E to be subjected to slotting by the stationary blade 65*a* of the second slotter unit 62 is basically equal to the rear flap dimension G to be subjected to slotting by the displaceable blade 65*b* of the first slotter unit 61 (E=G), the cutting part dimension S of the stationary blade 65*a* of the second slotter unit 62 is set to be equal to the cutting part dimension S of the displaceable blade 65*b* of the first slotter unit 61. Thus, the following description will be made on the assumption that the cutting part dimensions of the stationary blade 65*a* and the displaceable blade 65*b* are equal to each other. The just-mentioned way to derive the cutting part dimension S of the slotter blade 65 (each of the stationary blade 65*a* and the displaceable blade 65*b*) as mentioned here may be also applied to the after-mentioned other production modes (including insufficiency determination).

In this embodiment, as the given condition used for performing the excess determination in regard to the length of the slotter blade 65, in the above-mentioned first production mode, a condition is applied that the slotter device 6 does not simultaneously perform slotting on two corrugated paperboard sheets SH adjacent to each other in the conveyance direction FD. This condition is expressed, using the cutting part dimension S, the front flap dimension E, the box depth dimension F, the rear flap dimension G, the perimeter (peripheral length) N of the upper slotter 63, and a given margin value O, as the following formula (1a) or (1b).

$$S-E\leq(N-O)-(E+F+G) \quad (1a)$$

$$S-G\leq(N-O)-(E+F+G) \quad (1b)$$

In the formula (1a) or (1b), the left-hand side indicates a length by which the cutting part dimension S exceeds the flap dimension (E or G), and the right-hand side indicates a length obtained by subtracting the given margin value O from the length obtained by subtracting the overall length (E+F+G) of the corrugated paperboard sheets SH from the perimeter (N) of the upper slotter, i.e., the length of a part of the perimeter (N) of the upper slotter in which there is no corrugated paperboard sheets SH. Thus, as long as, in the formula (1a) or (1b), the value of the left-hand side is equal to or less than the value of the right-hand side, the slotter device 6 does not simultaneously perform slotting on two corrugated paperboard sheets SH adjacent to each other in the conveyance direction FD. In other words, if the value of the left-hand side is greater than the value of the right-hand side, the slotter device 6 will simultaneously perform slotting on two corrugated paperboard sheets SH adjacent to each other in the conveyance direction FD.

The above margin value O is the value of a margin set from a viewpoint of reliably suppressing the situation where the slotter device 6 simultaneously performs slotting on two corrugated paperboard sheets SH adjacent to each other in the conveyance direction FD. Specifically, the margin value O is set based on error in terms of attachment of the basic blade and the joint blade, deviation in terms of sheet feeding in the sheet feeding device 2, deviation in terms of conveyance of the corrugated paperboard sheet SH, etc. For example, the margin value O is set in the range of 10-20 mm.

A limit value X1 used for performing the excess determination in regard to the length of the slotter blade 65 is obtained by transforming the formula (1a) or (1b), and expressed as the formula (1c) or (1d). Thus, in this embodiment, as the excess determination in regard to the length of the slotter blade 65 in the first production mode, it is determined whether or not the cutting part dimension S of the slotter blade 65 exceeds the limit value X1 of the formula (1c) or (1d). Since the front flap dimension E is basically equal to the rear flap dimension G (this is also applied to the formula (1a) and the formula (1b)), the limit value X1 takes the same value, irrespective of which of the formula (1c) and the formula (1d) is used.

$$X1=N-E-F-O \quad (1c)$$

$$X1=N-G-F-O \quad (1d)$$

Specifically, in this embodiment, during the first production mode, when the cutting part dimension S of the slotter blade 65 exceeds the limit value X1, the slotter blade 65 is determined to be excessively long. In this case, a determination result indicating that the slotter blade 65 is excessively long is displayed on the slotter display device 104. This allows the operator to recognize that it is necessary to detach the joint blade or the like of the slotter blade 65 (in addition to the determination result, the fact that it is necessary to detach the slotter blade 65 may be displayed).

As above, in this embodiment, the excess determination in regard to the length of the slotter blade 65 can be accurately performed in the first production mode, so that it is possible to reliably prevent the situation where, due to an excessive length of the slotter blade 65, the slotter device 6 simultaneously cuts slots in two corrugated paperboard sheets SH adjacent to each other in the conveyance direction FD.

(Second Production Mode)

Figure 7:
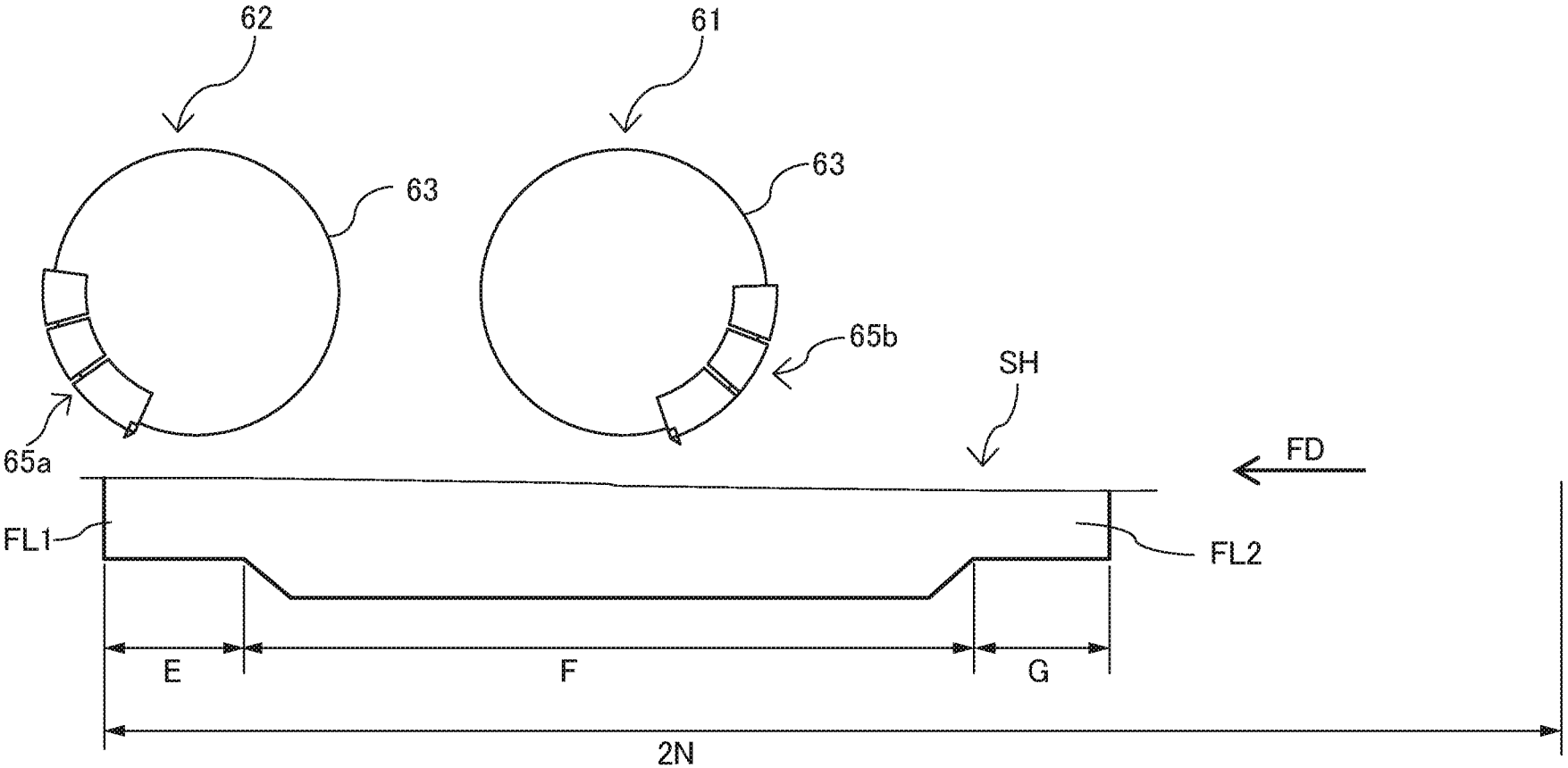
FIG. 7 is an explanatory diagram of the given condition and the limit value used in a second production mode in this embodiment.

With reference to FIG. 7, the given condition and the limit value used in a second production mode in this embodiment will be described. FIG. 7 schematically shows the first and second slotter units 61, 62 of the slotter device 6, and a corrugated paper board sheet SH to be subjected to slotting by the slotter device 6.

The second production mode is a production mode in which one corrugated paperboard sheet SH having a considerably long length in the conveyance direction is fed while the upper slotter 63 rotates 720 degrees, and slotting for the one corrugated paperboard sheet SH is performed by both the first and second slotter units 61, 62. The second production mode corresponds to a so-called skip-feed production in the double slotter mode (see, for example, JP-A 2016-098050). In this second production mode, the first slotter unit 61 is set up such that only the displaceable blade 65*b* is attached, and the second slotter unit 62 is set up such that only the stationary blade 65*a* is attached, wherein the front flap portion FL1 is subjected to slotting by the stationary blade 65*a* of the second slotter unit 62, and the rear flap portion FL2 is subjected to slotting by the displaceable blade 65*b* of the first slotter unit 61, as with the first production mode.

As the given condition used for performing the excess determination in regard to the length of the slotter blade 65, in the second production mode, the condition is also applied that the slotter device 6 does not simultaneously perform slotting on two corrugated paperboard sheets SH adjacent to each other in the conveyance direction FD. This condition is expressed, using the cutting part dimension S, the front flap dimension E, the box depth dimension F, the rear flap dimension G, the perimeter N of the upper slotter 63, and the given margin value O, as the following formula (2a) or (2b).

$$S-E\leq(2N-O)-(E+F+G) \quad (2a)$$

$$S-G\leq(2N-O)-(E+F+G) \quad (2b)$$

The formula (2a) or (2b) in the second production mode is different from the formula (1a) or (1b) in the first production mode, in that the right-hand side is expressed by using "2N" in place of "N". This is because, in the second production mode, the one corrugated paperboard sheet SH is fed during the period during which the upper slotter 63 rotates 720 degrees. A limit value X2 used for performing the excess determination in regard to the length of the slotter blade 65 is obtained by transforming the formula (2a) or (2b), and expressed as the formula (2c) or (2d). Thus, in this embodiment, as the excess determination in regard to the length of the slotter blade 65 in the second production mode, it is determined whether or not the cutting part dimension S of the slotter blade 65 exceeds the limit value X2 of the formula (2c) or (2d). Since the front flap dimension E is basically equal to the rear flap dimension G (this is also applied to the formula (2a) and the formula (2b)), the limit value X2 takes the same value, irrespective of which of the formula (2c) and the formula (2d) is used.

$$X2=2N-E-F-O \quad (2c)$$

$$X2=2N-G-F-O \quad (2d)$$

Specifically, in this embodiment, during the second production mode, when the cutting part dimension S of the slotter blade 65 exceeds the limit value X2, the slotter blade 65 is determined to be excessively long. In this case, a determination result indicating that the slotter blade 65 is excessively long is displayed on the slotter display device 104. This allows the operator to recognize that it is necessary to detach the joint blade or the like of the slotter blade 65 (in addition to the determination result, the fact that it is necessary to detach the slotter blade 65 may be displayed).

As above, in this embodiment, the excess determination in regard to the length of the slotter blade 65 can be accurately performed in the second production mode, so that it is possible to reliably prevent the situation where, due to an excessive length of the slotter blade 65, the slotter device 6 simultaneously cuts slots in two corrugated paperboard sheets SH adjacent to each other in the conveyance direction FD.

(Third Production Mode)

Figure 8:
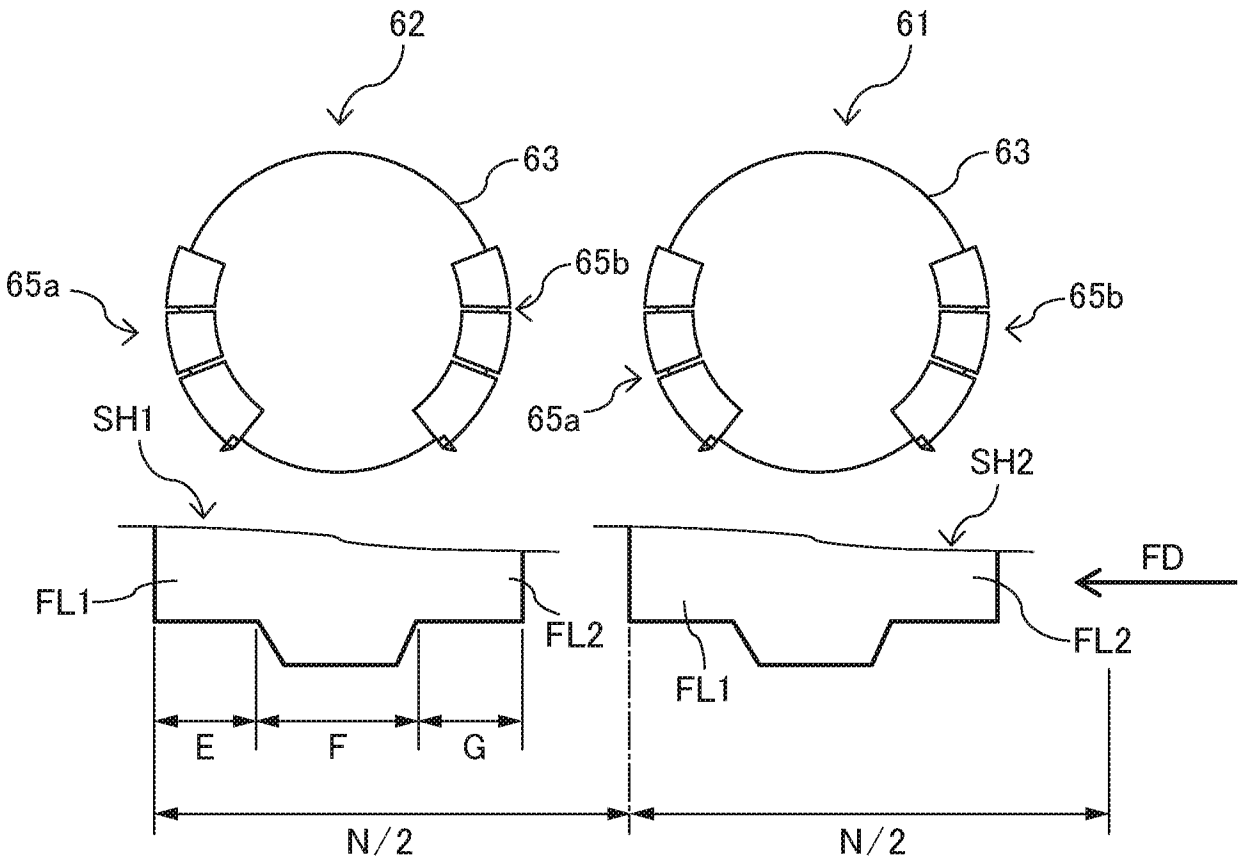
FIG. 8 is an explanatory diagram of the given condition and the limit value used in a third production mode in this embodiment.

With reference to FIG. 8, the given condition and the limit value used in a third production mode in this embodiment will be described. FIG. 8 schematically shows the first and second slotter units 61, 62 of the slotter device 6, and two corrugated paper board sheets SH1, SH2 to be subjected to slotting by the slotter device 6.

The third production mode is a production mode in which two corrugated paperboard sheets SH1, SH2 each having a relatively short length in the conveyance direction is fed while the upper slotter 63 rotates 360 degrees, and slotting for each of the two corrugated paperboard sheets SH1, SH2 is performed by a respective one of the first and second slotter units 61, 62. In this case, assume that the two corrugated paperboard sheets SH1, SH2 are conveyed with a distance therebetween according to a sheet feed interval of the sheet feeding device 2. The third production mode corresponds to a single slotter mode for so-called two-up production. In the third production mode, the stationary blade 65*a* and the displaceable blade 65*b* are attached to each of the first and second slotter units 61, 62. In the third production mode, the front flap portion FL1 and the rear flap portion FL2 of the corrugated paperboard sheet SH1 are subjected to slotting by the stationary blade 65*a* and the displaceable blade 65*b* of the second slotter unit 62, and the front flap portion FL1 and the rear flap portion FL2 of the corrugated paperboard sheet SH2 are subjected to slotting by the stationary blade 65*a* and the displaceable blade 65*b* of the first slotter unit 61.

Here, in a case where each of the stationary blade 65*a* and the displaceable blade 65*b* in each of the first and second slotter units 61, 62 comprises a basic blade whose cutting part dimension is $S_0$, and two joint blades whose cutting part dimensions are $S_1$ and $S_2$, respectively, the cutting part dimension S of each of the stationary blade 65*a* and the displaceable blade 65*b* is derived as "$S=S_0+S_1+S_2$", as mentioned in connection with the first production mode. On the other hand, in a case where the blade lengths of the basic blade and the two joint blades are $L_0$, $L_1$ and $L_2$, respectively, the blade length of each of the stationary blade 65*a* and the displaceable blade 65*b* is derived as "$L=L_0+L_1+L_2$". Basically, the blade length L of the stationary blade 65*a* is equal to that of the displaceable blade 65*b*. Further, in a commonly-used stationary blade 65*a* or displaceable blade 65*b*, the blade length L is equal to the cutting part dimension S (L=S).

As the given condition used for performing the excess determination in regard to the length of the slotter blade 65, in the above-mentioned third production mode, the condition is also applied that the slotter device 6 does not simultaneously perform slotting on two corrugated paperboard sheets SH adjacent to each other in the conveyance direction FD. This condition is expressed, using the cutting part dimension S, the front flap dimension E, the box depth dimension F, the rear flap dimension G, the perimeter N of the upper slotter 63, and the given margin value O, as the following formula (3a) or (3b).

$$S-E\leq(N/2-O)-(E+F+G) \quad (3a)$$

$$S-G\leq(N/2-O)-(E+F+G) \quad (3b)$$

The formula (3a) or (3b) in the third production mode is different from the formula (1a) or (1b) in the first production mode, in that the right-hand side is expressed by using "N/2" in place of "N". This is because, in the third production mode, the two corrugated paperboard sheets SH1, SH2 are fed during the period during which the upper slotter 63 rotates 360 degrees. A limit value X31 used for performing the excess determination in regard to the length of the slotter blade 65 is obtained by transforming the formula (3a) or (3b), and expressed as the formula (3c) or (3d). Thus, in this embodiment, as the excess determination in regard to the length of the slotter blade 65 in the third production mode, it is determined whether or not the cutting part dimension S of the slotter blade 65 exceeds the limit value X31 of the formula (3c) or (3d). Since the front flap dimension E is basically equal to the rear flap dimension G (this is also applied to the formula (3a) and the formula (3b)), the limit value X31 takes the same value, irrespective of which of the formula (3c) and the formula (3d) is used.

$$X31=N/2-E-F-O \quad (3c)$$

$$X31=N/2-G—F—O \quad (3d)$$

Subsequently, as the given condition used for performing the excess determination in regard to the length of the slotter blade 65 in the third production mode, a condition is applied that the stationary blade 65*a* and the displaceable blade 65*b* do not come into interference (i.e., contact) with each other on an outer periphery of the upper slotter 63 in each of the first and second slotter units 61, 62. This condition is expressed, using the blade length L, the box depth dimension F, the perimeter N of the upper slotter 63, and a given margin value Z, as the following formula (3e).

$$2\times L+F\leq N-Z \quad (3e)$$

In the formula (3e), the left-hand side indicates a length obtained by adding the sum (2×L) of respective blade lengths L of the stationary blade 65*a* and the displaceable blade 65*b*, and the box depth dimension F or a length by which the stationary blade 65*a* and the displaceable blade 65*b* are spaced apart from each other on the outer periphery of the upper slotter 63 so as to prevent a box depth portion of the corrugated paperboard sheet SH from being cut. Further, the right-hand side indicates a length obtained by subtracting the given margin value Z from the perimeter (N) of the upper slotter 63. Thus, as long as, in the formula (3e), the value of the left-hand side is equal to or less than the value of the right-hand side, the stationary blade 65*a* and the displaceable blade 65*b* do not come into interference (contact) with each other on the outer periphery of the upper slotter 63. In other words, if the value of the left-hand side is greater than the value of the right-hand side, the stationary blade 65*a* and the displaceable blade 65*b* will come into interference (contact) with each other on the outer periphery of the upper slotter 63.

The above margin value Z is the value of a margin set from a viewpoint of reliably suppressing the situation where the stationary blade 65*a* and the displaceable blade 65*b* come into interference with each other on the outer periphery of the upper slotter 63. For example, the margin value Z is set to about 10 mm.

A limit value X32 used for performing the excess determination in regard to the length of the slotter blade 65 is obtained by transforming the formula (3e), and expressed as the formula (3f). Thus, in this embodiment, as the excess determination in regard to the length of the slotter blade 65 in the third production mode, it is further determined whether or not the blade length L of the slotter blade 65 exceeds the limit value X32 of the formula (3f), in addition to the determination using the limit value X31 of the formula (3c) or (3d). Here, in the case where the blade length L is equal to the cutting part dimension S (in a commonly-used slotter blade 65, L=S), the cutting part dimension S may be used as the blade length L.

$$X32=(N-F-Z)/2 \tag{3f}$$

Specifically, in this embodiment, during the third production mode, when the cutting part dimension S of the slotter blade 65 exceeds the limit value X31 of the formula (3c) or (3d), or when the blade length L of the slotter blade 65 exceeds the limit value X32 of the formula (3f), the slotter blade 65 is determined to be excessively long. In this case, a determination result indicating that the slotter blade 65 is excessively long is displayed on the slotter display device 104. This allows the operator to recognize that it is necessary to detach the joint blade or the like of the slotter blade 65 (in addition to the determination result, the fact that it is necessary to detach the slotter blade 65 may be displayed).

As above, in this embodiment, the excess determination in regard to the length of the slotter blade 65 can be accurately performed in the third production mode, so that it is possible to reliably prevent the situation where, due to an excessive length of the slotter blade 65, the slotter device 6 simultaneously cuts slots in two corrugated paperboard sheets SH adjacent to each other in the conveyance direction FD, and the situation where, due to an excessive length of the slotter blade 65, the stationary blade 65*a* and the displaceable blade 65*b* come into interference (contact) with each other on the outer periphery of the upper slotter 63.

(Fourth Production Mode)

Figure 9:
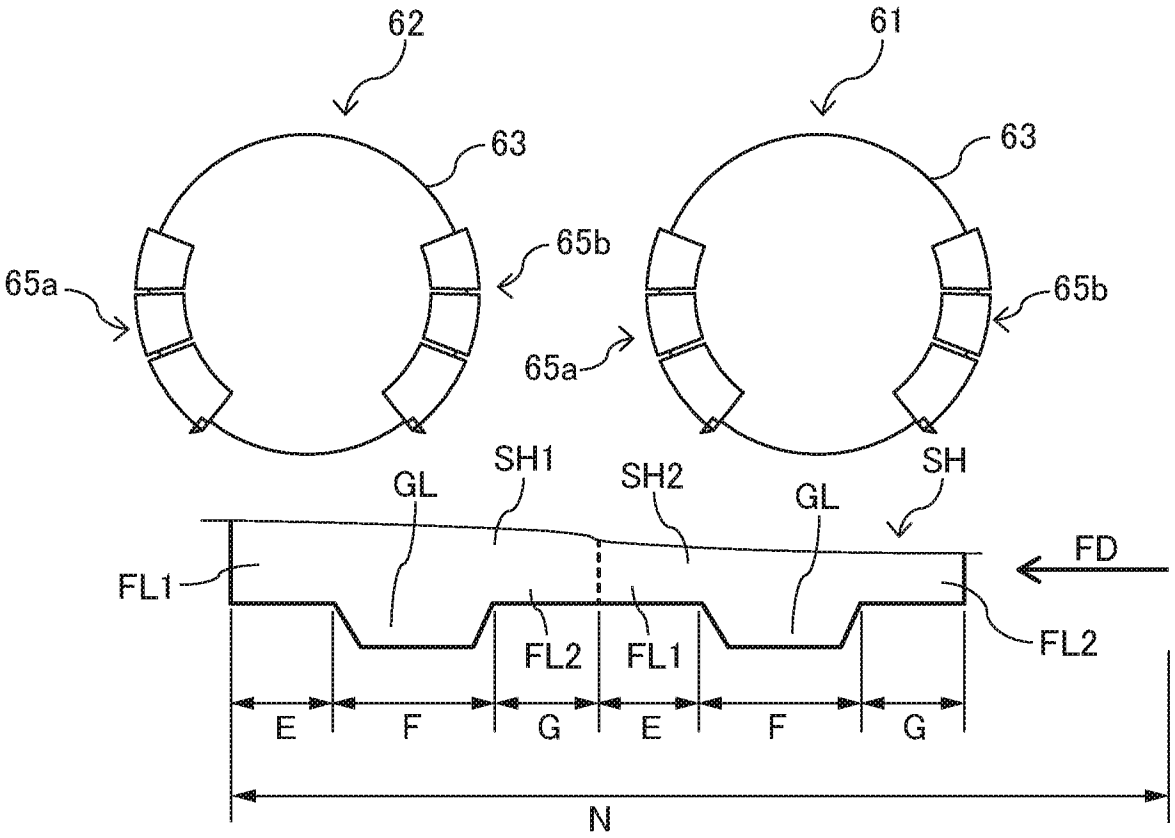
FIG. 9 is an explanatory diagram of the given condition and the limit value used in a fourth production mode in this embodiment.

With reference to FIG. 9, the given condition and the limit value used in a fourth production mode in this embodiment will be described. FIG. 9 schematically shows the first and second slotter units 61, 62 of the slotter device 6, and a corrugated paper board sheet SH to be subjected to slotting by the slotter device 6.

The fourth production mode is a production mode in which one corrugated paperboard sheet SH consisting of two continuously-connected corrugated paperboard sheet elements SH1, SH2 to be cut into front and rear parts by the die-cutter device 7 is fed during the period during which the slotter rotates 360 degrees, and slotting for each of the one corrugated paperboard sheet SH is performed by both the first and second slotter units 61, 62. The fourth production mode corresponds to a production mode different from the third production mode, in the single slotter mode for so-called two-up production. In the fourth production mode, the stationary blade 65*a* and the displaceable blade 65*b* are attached to each of the first and second slotter units 61, 62, as with the third production mode, wherein the front flap portion FL1 and the rear flap portion FL2 of the corrugated paperboard sheet element SH1 are subjected to slotting by the stationary blade 65*a* and the displaceable blade 65*b* of the second slotter unit 62, and the front flap portion FL1 and the rear flap portion FL2 of the corrugated paperboard sheet element SH2 are subjected to slotting by the stationary blade 65*a* and the displaceable blade 65*b* of the first slotter unit 61.

As the given condition used for performing the excess determination in regard to the length of the slotter blade 65, in the above-mentioned fourth production mode, the condition is also applied that the slotter device 6 does not simultaneously perform slotting on two corrugated paperboard sheets SH adjacent to each other in the conveyance direction FD. This condition is expressed, using the cutting part dimension S, the front flap dimension E, the box depth dimension F, the rear flap dimension G, the perimeter N of the upper slotter 63, and the given margin value O, as the following formula (4a) or (4b).

$$S-E\leq(N-O)-2\times(E+F+G) \tag{4a}$$

$$S-G\leq(N-O)-2\times(E+F+G) \tag{4b}$$

The formula (4a) or (4b) in the fourth production mode is different from the formula (1a) or (1b) in the first production mode, in that the right-hand side is expressed by using "2×(E+F+G)" in place of "(E+F+G)". This is because, in the fourth production mode, the one corrugated paperboard sheet SH consisting of two continuously-connected corrugated paperboard sheet elements SH1, SH2 is fed during the period during which the upper slotter 63 rotates 360 degrees. A limit value X41 used for performing the excess determination in regard to the length of the slotter blade 65 is obtained by transforming the formula (4a) or (4b), and expressed as the formula (4c) or (4d). Thus, in this embodiment, as the excess determination in regard to the length of the slotter blade 65 in the fourth production mode, it is determined whether or not the cutting part dimension S of the slotter blade 65 exceeds the limit value X41 of the formula (4c) or (4d). Since the front flap dimension E is basically equal to the rear flap dimension G (this is also applied to the formula (4a) and the formula (4b)), the limit value X41 takes the same value, irrespective of which of the formula (4c) and the formula (4d) is used.

$$X41=N-E-2F-2G-O \tag{4c}$$

$$X41=N-2E-2F-G-O \tag{4d}$$

Subsequently, as the given condition used for performing the excess determination in regard to the length of the slotter blade 65 in the fourth production mode, the condition is applied that the stationary blade 65*a* and the displaceable blade 65*b* do not come into interference (i.e., contact) with each other on the outer periphery of the upper slotter 63, as with the third production mode. This condition is expressed, using the blade length L, the box depth dimension F, the perimeter N of the upper slotter 63, and the given margin value Z, as the following formula (4e).

$$2\times L+F\leq N-Z \tag{4e}$$

A limit value X42 used for performing the excess determination in regard to the length of the slotter blade 65 is obtained by transforming the formula (4e), and expressed as the formula (4f). Thus, in this embodiment, as the excess determination in regard to the length of the slotter blade 65 in the fourth production mode, it is further determined whether or not the blade length L of the slotter blade 65 exceeds the limit value X42 of the formula (40, in addition to the determination using the limit value X41 of the formula (4c) or (4d). Here, in the case where the blade length L is equal to the cutting part dimension S (in a commonly-used slotter blade 65, L=S), the cutting part dimension S may be used as the blade length L.

$$X42=(N-F-Z)/2 \quad (4f)$$

Subsequently, in the fourth production mode, a condition is further applied that the slotter blade 65 does not perform slotting on the glue portion GL. This condition is expressed, using the cutting part dimension S, the front flap dimension E, the rear flap dimension G, and a given margin value Q, as the following formula (4g).

$$S \leq E+G-Q \quad (4g)$$

The formula (4g) means that the slotter blade 65 does not perform slotting on the glue portion GL, as long as the cutting part dimension S of the slotter blade 65 is equal to or less than a length obtained by subtracting the given margin value Q from the sum (E+G) of the rear flap portion FL2 of the corrugated paperboard sheet element SH1 and the front flap portion FL1 of the corrugated paperboard sheet element SH2 lying between the front and rear glue portions GL in the corrugated paperboard sheets SH. The margin value Q is the value of a margin set from a viewpoint of reliably suppressing the situation where the slotter blade 65 performs slotting on the glue portion GL. For example, the margin value Z is set in the range of 10 to 20 mm.

A limit value X43 used for performing the excess determination in regard to the length of the slotter blade 65 is obtained from the formula (4g), and expressed as the formula (4h). Thus, in this embodiment, as the excess determination in regard to the length of the slotter blade 65 in the fourth production mode, it is further determined whether or not the cutting part dimension S of the slotter blade 65 exceeds the limit value X43 of the formula (4h), in addition to the determinations using the limit value X41 of the formula (4c) or (4d) and the limit value X42 of the formula (4f).

$$X43=E+G-Q \quad (4h)$$

Specifically, in this embodiment, during the fourth production mode, when the cutting part dimension S of the slotter blade 65 exceeds the limit value X41 of the formula (4c) or (4d), or when the blade length L of the slotter blade 65 exceeds the limit value X42 of the formula (4f), or when the cutting part dimension S of the slotter blade 65 exceeds the limit value X43 of the formula (4h), the slotter blade 65 is determined to be excessively long. In this case, a determination result indicating that the slotter blade 65 is excessively long is displayed on the slotter display device 104. This allows the operator to recognize that it is necessary to detach the joint blade or the like of the slotter blade 65 (in addition to the determination result, the fact that it is necessary to detach the slotter blade 65 may be displayed).

As above, in this embodiment, the excess determination in regard to the length of the slotter blade 65 can be accurately performed in the fourth production mode, so that it is possible to reliably prevent: the situation where, due to an excessive length of the slotter blade 65, the slotter device 6 simultaneously cuts slots in two corrugated paperboard sheets SH adjacent to each other in the conveyance direction FD; the situation where, due to an excessive length of the slotter blade 65, the stationary blade 65*a* and the displaceable blade 65*b* come into interference (contact) with each other on the outer periphery of the upper slotter 63; and the situation where, due to an excessive length of the slotter blade 65, the slotter device 6 cuts the glue portion GL.

<Insufficiency Determination in Regard to Length of Slotter Blade>

Next, insufficiency determination in regard to the length of the slotter blade 65 in this embodiment will be described. In this embodiment, in addition to the excess determination, determination as to whether or not the length of the slotter blade 65 is insufficient with respect to a length by which a corrugated paperboard sheet SH needs to be slotted (i.e., the front flap dimension E and the rear flap dimension G).

Specifically, the insufficiency determination in regard to the length of the slotter blade 65 is performed using the below-mentioned formula (5a) or (5b) expressed by the cutting part dimension S, the front flap dimension E, the rear flap dimension G, and a given margin value Y. The given margin value Y is a correction amount of a tolerance of the flap dimension E or G which is allowed to be cut by a set of cutter blades 65, and set to, e.g., about 10 mm. A value obtained from the right-hand side of the formula (5a) or (5b) serves as a limit value for use in the insufficiency determination. Since the front flap dimension E is basically equal to the rear flap dimension G, the limit value takes the same value, irrespective of which of the formula (5a) and the formula (5b) is used.

$$S \geq E+Y \quad (5a)$$

$$S \geq G+Y \quad (5b)$$

In this embodiment, when the cutting part dimension S meets the condition expressed by the formula (5a) or (5b), i.e., the cutting part dimension S is equal to or greater than the limit value, it is determined that the length of the slotter blade 65 is not insufficient. On the other hand, when the cutting part dimension S is less than the limit value, it is determined that the length of the slotter blade 65 is insufficient. In the latter case, a determination result indicating that the length of the slotter blade 65 is insufficient is displayed on the slotter display device 104. This allows the operator to recognize that it is necessary to attach the joint blade or the like of the slotter blade 65 (in addition to the determination result, the fact that it is necessary to attach the slotter blade 65 may be displayed). Therefore, it becomes possible to prevent defective processing which would otherwise occur when the length of the slotter blade 65 is insufficient.

<Control for Attaching/Detaching of Slotter Blade>

Next, the following description will be made about control for allowing attaching/detaching of the slotter blade 65 to be performed by the operator when the length of the slotter blade 65 is determined to be excessive or insufficient in the excess determination or insufficiency determination in this embodiment.

Figure 10A:
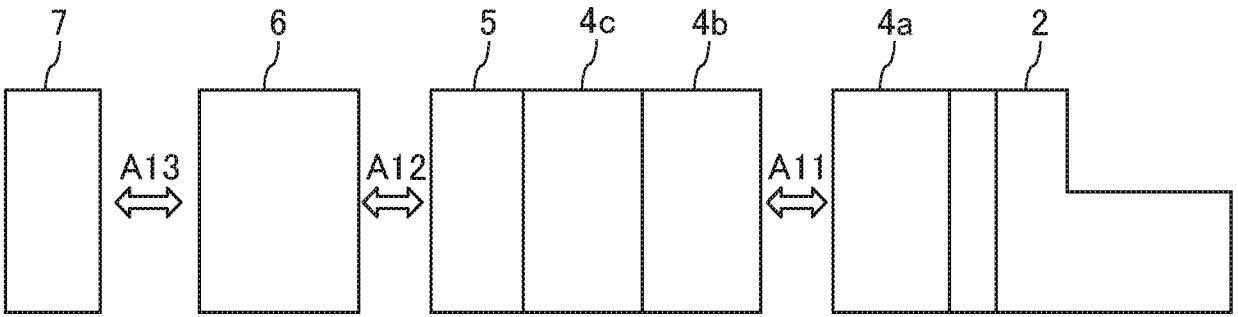
FIG. 10A is an explanatory diagram of an opening control for slotter blade attaching/detaching in this embodiment, in a case where an open operation for one printing unit is performed.
Figure 10B:
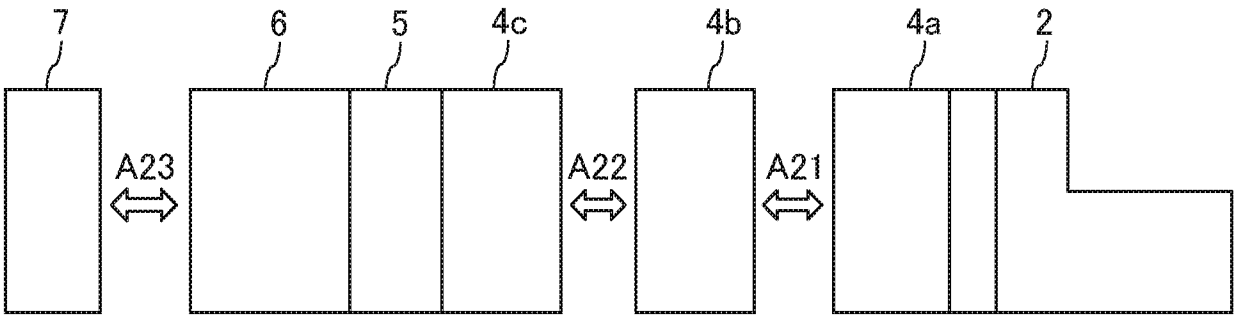
FIG. 10B is an explanatory diagram of the opening control for the slotter blade attaching/detaching in this embodiment, in a case where an open operation for two printing units is performed.

FIGS. 10A and 10B are explanatory diagrams of opening control for allowing attaching/detaching of the slotter blade 65 to be performed, in this embodiment. Specifically, FIGS. 10A and 10B are front views schematically showing the plurality of processing devices (the sheet feeding device 2, the printing units 4*a* to 4*c*, the creaser device 5, the slotter device 6, and the die-cutter device 7) in the corrugated paperboard box making machine 1.

In this embodiment, during setup for production of the next order, when the length of a slotter blade 65 currently attached to the slotter device 6 is determined to be excess or insufficient, an opening control for widening an interval between the slotter device 6 and a processing device adjacent thereto (the creaser device 5 and/or the die-cutter device 7) is performed, prior to production of the next order (specifically, during an order change period after completion of the previous order through until the next order is started. In this way, it is possible to quickly ensure a space for performing the operation of attaching/detaching the slotter blade 65 during the order change period.

More specifically, in this embodiment, an open operation of widening only an interval between the slotter device 6 and the die-cutter device 7, and an open operation of widening both the interval between the slotter device 6 and the die-cutter device 7 and an interval between the slotter device 6 and the creaser device 5 are switched, depending on the number of printing units whose printing plates need to be replaced for production of the next order, among the printing units 4*a* to 4*c*, i.e., depending on the number of printing units to be subjected to the open operation. This makes it possible to maximally widen the interval between the slotter device 6 and a processing device adjacent thereto, according to the condition of the open operation in the printing units 4*a* to 4*c*. The above opening control is performed with respect to the moving mechanism 132 by the opening control device 130, according to the control instruction information from the lower-level management device 110 (see FIG. 3).

FIG. 10A shows a case where there is a need to replace the printing plate 44 of only the printing unit 4*b*, i.e., to perform the open operation for only the printing unit 4*b*, for production of the next order (arrowed line A11). In this case, the open operation of simultaneously widening both the interval between the slotter device 6 and the die-cutter device 7 and the interval between the slotter device 6 and the creaser device 5 is performed (arrowed lines A12, A13). On the other hand, FIG. 10B shows a case where there is a need to replace the printing plates 44 of the printing units 4*b*, 4*c*, i.e., to perform the open operation for the two printing units 4*b*, 4*c*, for production of the next order (arrowed lines A21, A22). In this case, since it is impossible to perform the open operation of simultaneously widening both the interval between the slotter device 6 and the die-cutter device 7 and the interval between the slotter device 6 and the creaser device 5, an open operation of widening only the interval between the slotter device 6 and the die-cutter device 7 is performed (arrowed line A23). That is, in order to allow the punching dies 73 of the die-cutter device 7 to be replaced, the open operation of widening the interval between the slotter device 6 and the die-cutter device 7 is performed in priority to the open operation of widening the interval between the slotter device 6 and the creaser device 5. After completion of the replacement of the punching dies 73, the interval between the slotter device 6 and the die-cutter device 7 is closed, and then the open operation of widening the interval between the slotter device 6 and the creaser device 5 is performed.

Here, a reason that it is necessary to switch between the open operations, depending on the number of printing units whose printing plates 44 need to be replaced, in the above manner, will be described with an example. Specifically, the reason will be described by taking, as an example, a case where: a maximum opening dimension of the entire corrugated paperboard box making machine 1 is 2400 mm; an opening dimension of one printing unit is 600 mm; an opening dimension between the creaser device 5 and the slotter device 6 is 600 mm; and an opening dimension between the slotter device 6 and the die-cutter device 7 is 800 mm. In a case where the number of printing units whose printing plates need to be replaced is one, "total opening dimension=the opening dimension of one printing unit+the opening dimension between the creaser device and the slotter device+the opening dimension between the slotter device and the die-cutter device". This formula is calculated as 2000 mm from "600×1+600+800". This total opening dimension "2000 mm" is less than the maximum opening dimension "2400 mm" of the entire corrugated paperboard box making machine 1. Thus, it is possible to perform the open operation of simultaneously widening both the interval between the slotter device 6 and the die-cutter device 7 and the interval between the slotter device 6 and the creaser device 5. On the other hand, in a case where the number of printing units whose printing plates need to be replaced is two, the total opening dimension is 2600 mm from "600×2+600+800". This total opening dimension "2600 mm" is greater than the maximum opening dimension "2400 mm" of the entire corrugated paperboard box making machine 1. Thus, it is impossible to perform the open operation of simultaneously widening both the interval between the slotter device 6 and the die-cutter device 7 and the interval between the slotter device 6 and the creaser device 5.

Figure 11:
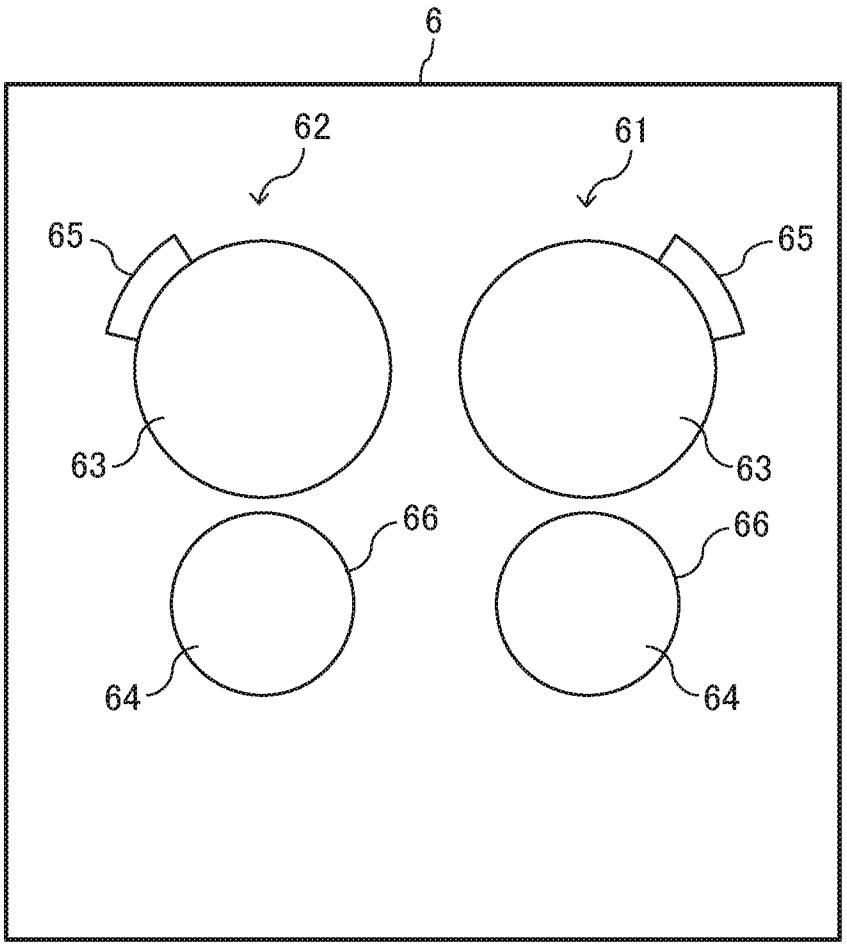
FIG. 11 is an explanatory diagram of control of circumferentially positioning a slotter blade so as to allow attaching/detaching of the slotter blade to be performed.

Next, FIG. 11 is an explanatory diagram of control of circumferentially positioning the slotter blade 65 so as to allow the attaching/detaching of the slotter blade 65 to be performed, in this embodiment. FIG. 11 is a front view schematically showing the first and second slotter units 61, 62 of the slotter device 6 in this embodiment.

In this embodiment, during setup for production of the next order, when the length of a slotter blade 65 currently attached to the slotter device 6 is determined to be excess or insufficient, control of circumferentially positioning the slotter blade 65, prior to production of the next order (specifically, during an order change period). Specifically, as shown in FIG. 11, the circumferential positioning control for the slotter blade 65 of the upper slotter 63 is performed so as to prevent the slotter blade 65 from engaging with the slotter blade 66 of the lower slotter 64. This makes it easy for the operator to perform the attaching/detaching operation for the slotter blade 65. Preferably, the circumferential positioning control for the slotter blade 65 is performed such that the slotter blades 65 of the first and second slotter units 61, 62 are positioned, respectively, in opposed relatively-outward regions in the slotter device 6, and to face upwardly. This positioning control is performed by the slotter control device 126, according to the control instruction information from the lower-level management device 110 (see FIG. 3).

Further, when performing the circumferential positioning control for the slotter blade 65, it is more preferable to simultaneously perform control of positioning the plurality of sets of slotters composed of the upper slotter 63 and the lower slotter 64 at even intervals in a direction orthogonal to the conveyance direction (this orthogonal direction will hereinafter be referred to appropriately as "yoke direction"). This makes it possible to ensure a space for performing the attaching/detaching operation of the slotter blade 65, thereby making it easier for the operator to perform the attaching/detaching operation for the slotter blade 65. The circumferential positioning control for the slotter blade 65 and the positioning control for the plurality of sets of slotters in the yoke direction are performed, prior to the aforementioned opening control.

<Display Screen>

Next, the following description will be made about a display screen to be displayed depending on the excess determination and the insufficiency determination in regard to the length of the slotter blade 65 in this embodiment. FIG. 12 illustrates an example of a display screen to be displayed on the display device 102 connected to the upper-level management device 100, according to the excess determination and the insufficiency determination in regard to the length of the slotter blade 65 in this embodiment.

First of all, in this embodiment, the upper-level management device 100 operates to, based on dimensions (the flap dimension and the box depth dimension) of a corrugated paperboard box to be produced according to each of a plurality of orders, and a production mode (one of the first to fourth production modes) to be set in each of the plurality of orders, set the limit value to be used in each of the excess determination and the insufficiency determination in regard to the length of the slotter blade 65, with respect to each of the plurality of orders (as for the details, see the sections "Excess Determination in Regard to Length of Slotter Blade" and "Insufficiency Determination in Regard to Length of Slotter Blade"). Then, the upper-level management device 100 operates to perform, with respect to each of the plurality of orders, determination (excess determination) as to whether or not the length of the slotter blade 65 exceeds the limit valve, and determination (insufficiency determination) as to whether or not the length of the slotter blade 65 is insufficient with respect to the limit valve, by using, as the length of the slotter blade 65, a length determined by a given basic blade and joint blade combination (e.g., a predetermined combination of one basic blade and two joint blades) to be attached to the slotter device 6.

Then, the upper-level management device 100 operates to further determine, with respect to each of the plurality of orders, whether or not the basic blade and/or the joint blade need to be attached/detached to/from the given basic blade and joint blade combination, according to results of the excess determination and the insufficiency determination, and cause the display device 102 to display thereon the determination results in association with each of the plurality of orders, in the form of a list. The upper-level management device 100 operates to, when the length of the slotter blade 65 exceeds the limit value, determine that the basic blade and/or the joint blade need to be detached from the given basic blade and joint blade combination, and, when the length of the slotter blade 65 is insufficient with respect to the limit value, determine that the basic blade and/or the joint blade need to be attached to the given basic blade and joint blade combination. Further, the upper-level management device 100 operates to, when the length of the slotter blade 65 does not exceeds the limit value, and the length of the slotter blade 65 is not insufficient with respect to the limit value, determine that the basic blade and/or the joint blade need to be neither attached nor detached to/from the given basic blade and joint blade combination. This makes it possible to, with respect to each of the plurality of orders, accurately perform the excess determination and the insufficiency determination in regard to the length of the slotter blade 65, and accurately perform determination as to the necessity of attaching/detaching to/from the slotter blade 65.

When it is determined that the basic blade and/or the joint blade need to be neither attached nor detached, determination as to whether attaching or detaching of the basic blade and/or the joint blade is permitted may be performed. For example, in production of a given order, assuming that the length of a slotter blade 65 consisting of a combination of one basic blade and two joint blades (a joint blade 1 and a second joint blade 2) does not exceed the limit value, when it is determined that the length of a slotter blade 65 consisting of a combination of one basic blade and the joint blade 1 after detaching the second joint blade 2 is not insufficient with respect to the limit value, it may be determined that attaching or detaching of the joint blade 2 is permitted.

In FIG. 12, with regard to each of the first and second slotter units 61, 62, the necessity of attaching/detaching to/from the basic blade and the two joint blades in each of the stationary blade 65*a* and the displaceable blade 65*b* is displayed in the form of a list, in association with the four different orders. In FIG. 12, "B" denotes a given basic blade, and "J1" and "J2" denote, respectively, one of two given joint blades, and the other joint blade, Further, "■" and "●" denote, respectively, that the given basic blade needs to be attached, and that the given joint blade needs to be attached, and "–" and "○" denote, respectively, that the given basic blade or the given joint blade needs to be detached, and that the given joint blade needs to be neither attached nor detached (although not shown in the figure, when the given basic blade needs to be neither attached nor detached, "□" is displayed). The display screen as shown in FIG. 12 makes it possible for the operator to easily visually figure out the necessity of attaching/detaching to/from the slotter blade 65, with respect to each of the plurality of orders.

Figure 13:
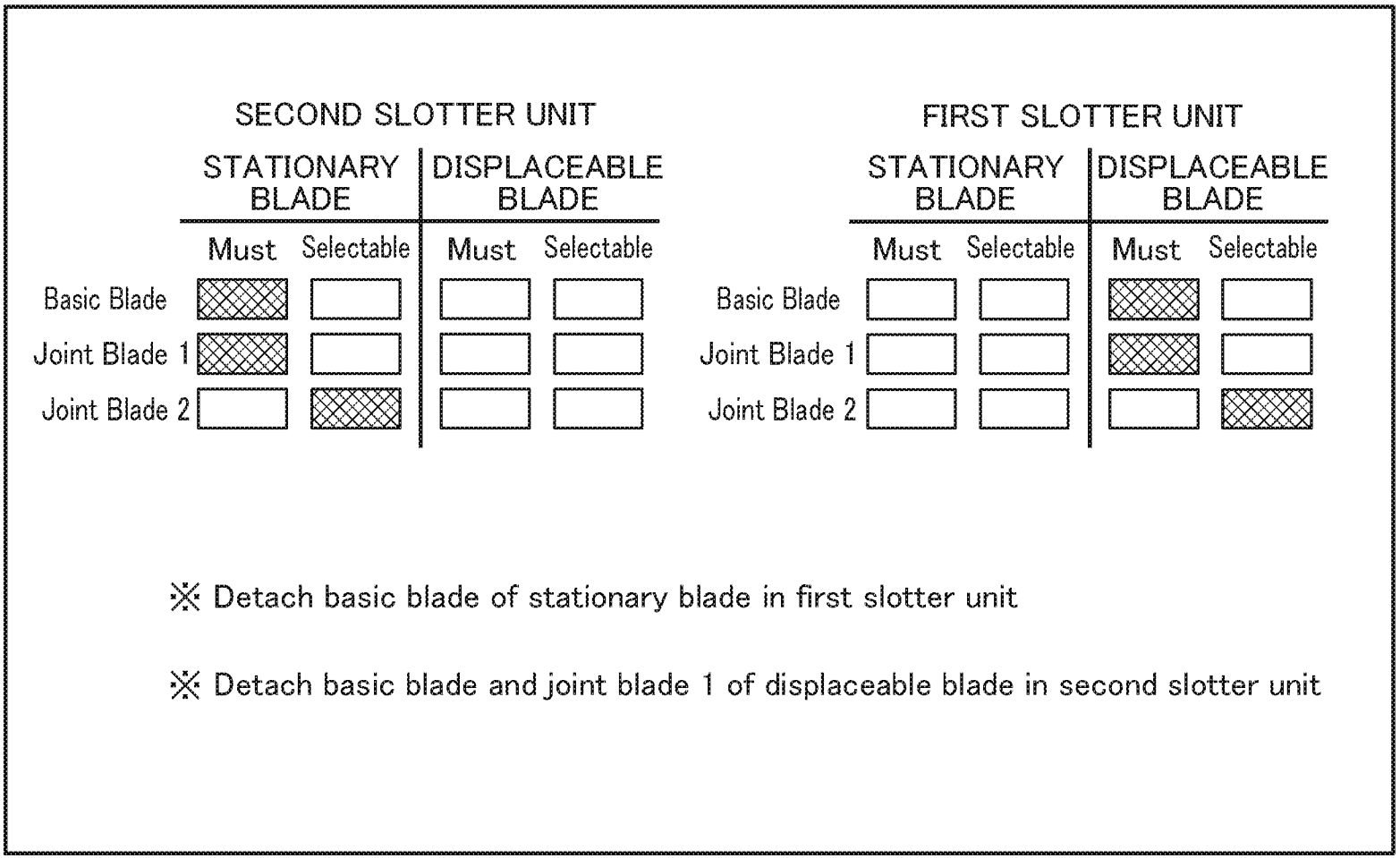
FIG. 13 illustrates an example of a display screen on a slotter display device, according to the excess determination and the insufficiency determination in regard to the length of the slotter blade in this embodiment.

Next, FIG. 13 illustrates an example of a display screen to be displayed on the slotter display device 104, according to the excess determination and the insufficiency determination in regard to the length of the slotter blade 65 in this embodiment. This display screen is basically displayed on the slotter display device 104 under the control of the lower-level management device 110. As shown in the upper side of FIG. 13, with regard to the next order, the necessity of attaching/detaching to/from the given basic blade and the two given joint blades is displayed on the slotter display device 104. Among the necessity of the attaching/detaching displayed with respect to the plurality of orders in the form of a list as shown in FIG. 12, only information corresponding to the next order is displayed on the slotter display device 104. Specifically, with regard to each of the first and second slotter units 61, 62, the necessity of attaching/detaching to/from the basic blade and the two joint blades 1, 2 in each of the stationary blade 65*a* and the displaceable blade 65*b* in the next order is displayed. In FIG. 13, when a mark is placed on "Must", it indicates that a corresponding one of the basic blade, the joint blade 1 and the joint blade 2 needs to be attached, and when a mark is placed on "Selectable", it indicates that a corresponding one of the basic blade, the joint blade 1 and the joint blade 2 don't need to be attached (in other words, it indicates that the corresponding one of the basic blade, the joint blade 1 and the joint blade 2 may be attached or may be detached). Further, no mark is placed on either of "Must" and "Selectable", it indicates that a corresponding one of the basic blade, the joint blade 1 and the joint blade 2 needs to be detached.

Further, as shown in the lower side of FIG. 13, a result of determination as to whether or not a slotter blade 65 currently attached to the slotter unit 6 needs to be attached/detached for production of the next order is displayed on the slotter display device 104. FIG. 13 shows an example in which an alarm indicating that the basic blade of the stationary blade 65*a* in the first slotter unit 61 needs to be detached, and the basic blade and the joint blade 1 of the displaceable blade 65*b* in the second slotter unit 62 needs to be detached is displayed. In response to this alarm display, the operator can reliably perform the attaching/detaching operation for the currently-attached slotter blade 65.

<Flowchart>

Figure 14A:
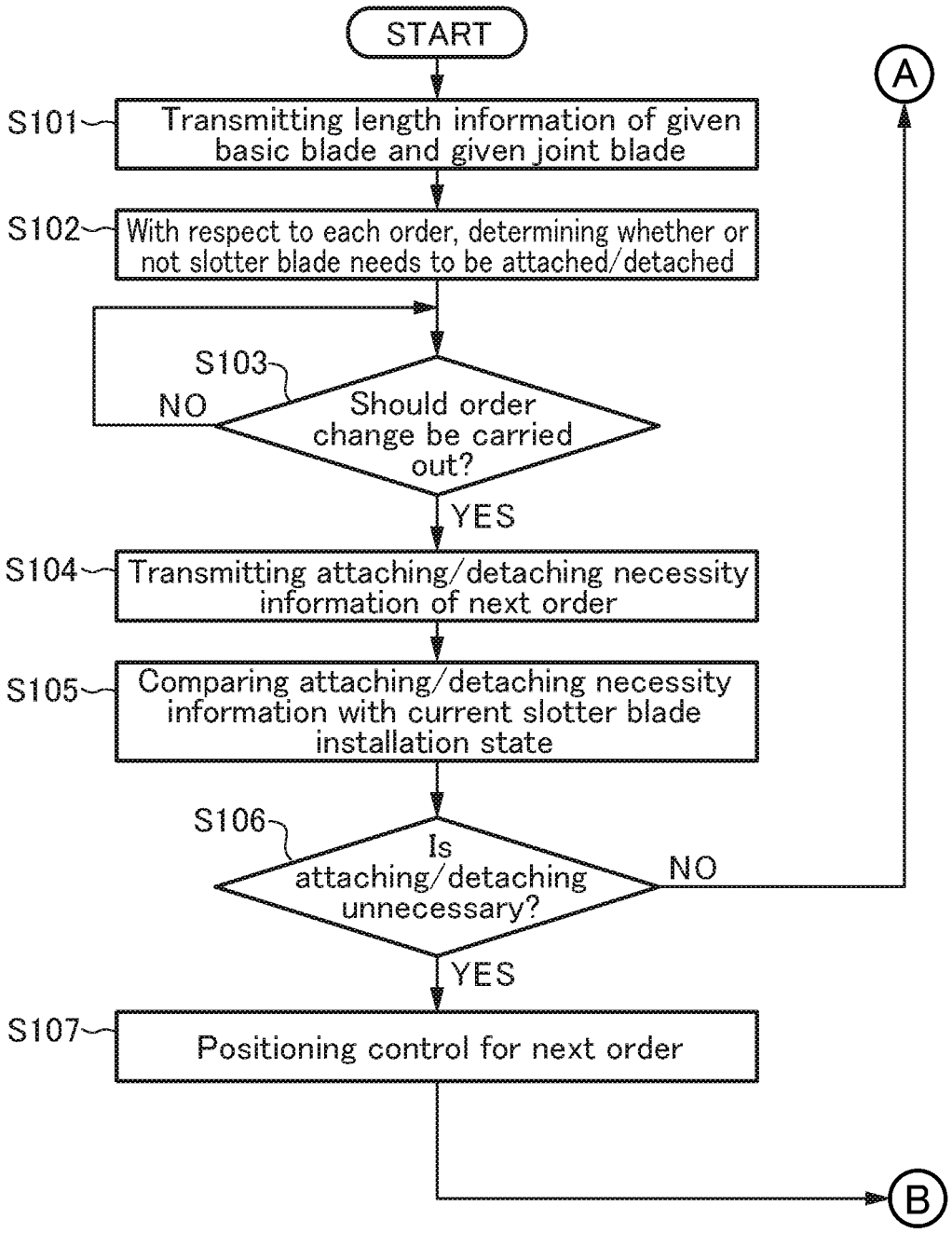
FIG. 14A is a flowchart showing a control process in this embodiment.
Figure 14B:
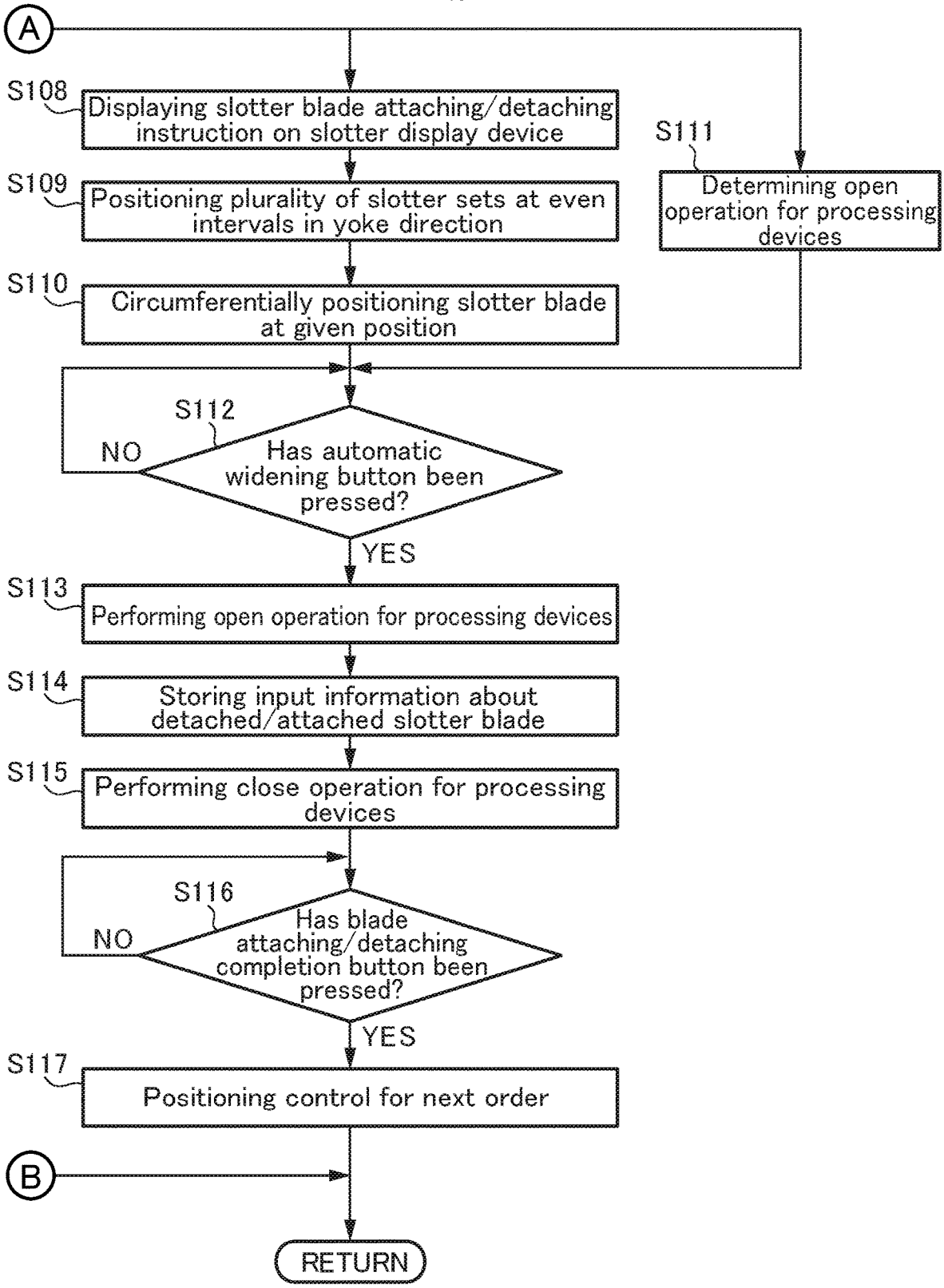
FIG. 14B is a flowchart showing the control process in this embodiment.

Next, a flow of processing such as the aforementioned determinations and controls will be specifically described with reference to FIGS. 14A and 14B. FIGS. 14A and 14B are flowcharts showing a control process in this embodiment. This control process is executed by the upper-level management device 100 and the lower-level management device 110.

First of all, in step S101, the lower-level management device 110 transmits, to the upper-level management device 100, information about a given basic blade and a given joint blade to be attached to the slotter device 6. Specifically, the lower-level management device 110 transmits, to the upper-level management device 100, length information, i.e., information about the cutting part dimension S and the blade length L, of each of the given basic blade and the given joint blade. For example, the lower-level management device 110 transmits length information of a predetermined combination of one given basic blade and two given joint blades.

Subsequently, in step S102, based on a plurality of pieces of stored order information (product management schedule), the upper-level management device 100 determines whether or not the basic blade and/or the joint blade need to be attached/detached to/from the given basic blade and joint blade combination, with respect to each of a plurality of orders. In this case, with respect to each of the plurality of orders, a limit value for use in each of the excess determination and the insufficiency determination in regard to the length of the slotter blade 65 is set, based on dimensions (the flap dimension and the box depth dimension) of a corrugated paperboard box to be produced according to each of the plurality of orders, and a production mode (one of the first to fourth production modes) to be set in each of the plurality of orders. Then, with respect to each of the plurality of orders, the upper-level management device 100 performs determination as to whether or not the length of the slotter blade 65 exceeds the limit value (excess determination), and determination as to whether or not the length of the slotter blade 65 is insufficient with respect to the limit value (insufficiency determination), by using, as the length of the slotter blade 65, the lengths of the given basic blade and the given joint blade acquired in the step S101, i.e., a length determined by a given basic blade and joint blade combination to be attached to the slotter device 6. Then, depending a result of the excess determination and the insufficiency determination, the upper-level management device 100 determines whether or not the basic blade and/or the joint blade need to be attached/detached to/from the given basic blade and joint blade combination, with respect to each of the plurality of orders. Further, the upper-level management device 100 causes the display device 102 to display the determination result in association with each of the plurality of orders, in the form of a list (see FIG. 12).

Subsequently, in step S103, the lower-level management device 110 determines whether or not an order change operation should be carried out. Specifically, the lower-level management device 110 determines whether or not an order change operation should be carried out, based on the presence or absence of receiving of an order change instruction signal from the upper-level management device 100. When it is determined that the order change operation should be carried out (step S103: YES), the process proceeds to step S104. On the other hand, when it is determined that order change operation should not be carried out (step S103: NO), the determination in the step S103 will be repeated.

Subsequently, in the step S104, the upper-level management device 100 transmits, to the lower-level management device 110, information about the determination result of the necessity of attaching/detaching of the slotter blade 65, corresponding to the next order, among the determination results of the necessity of attaching/detaching of the slotter blade 65 with respect to the plurality of orders, obtained in the step S102.

Subsequently, in step S105, the lower-level management device 110 compares the attaching/detaching necessity information of the next order transmitted from the upper-level management device 100 in step S104, with a state of a slotter blade 65 currently attached to the slotter device 6, i.e., a current installation state of the basic blade and/or the joint blade. Then, in step S106, based on a result of the above comparison, the lower-level management device 110 determines whether the attaching/detaching operation is unnecessary for the current basic blade and/or joint blade, with regard to production of the next order.

In the step S106, when it is determined that the attaching/detaching operation is unnecessary for the current basic blade and/or joint blade (step S106: YES), the process proceeds to step S107. In the step S107, through the slotter control device 126, the lower-level management device 110 performs the control of positioning the stationary blade 65*a* and/or the displaceable blade 65*d* in each of the first and second slotter units 61, 62, for the next order.

On the other hand, when it is determined that the attaching/detaching operation is necessary for the current basic blade and/or joint blade (step S106: NO), the process proceeds to step S108. In the step S108, the lower-level management device 110 causes the slotter display device 104 to display an instruction for attaching/detaching of the slotter blade 65 (see, for example, FIG. 13). Specifically, the lower-level management device 110 causes the slotter display device 104 to display an alarm indicating that, with respect to the stationary blade 65*a* and/or the displaceable blade 65*b* in each of the first and second slotter units 61, 62, the relevant basic blade and/or joint blade need to be detached or attached.

Subsequently, in step S109, through the slotter control device 126, the lower-level management device 110 performs control of positioning the plurality of sets of slotters composed of the upper slotter 63 and the lower slotter 64 at even intervals in the yoke direction (direction orthogonal to the conveyance direction FD). Then, in step S110, through the slotter control device 126, the lower-level management device 110 performs control of circumferentially positioning the slotter blade 65. Specifically, the lower-level management device 110 performs the control of circumferentially positioning the slotter blade 65, so as to prevent the slotter blade 65 of the upper slotter 63 from engaging with the slotter blade 66 of the lower slotter 64, and allow the slotter blades 65 of the first and second slotter units 61, 62 to be located, respectively, in the opposed relatively-outward regions in the slotter device 6 (see FIG. 11).

In concurrence with the steps S108 to S110, in step S111, the lower-level management device 110 determines whether to perform an open operation of widening only an interval between the slotter device 6 and the die-cutter device 7, or an open operation of widening both the interval between the slotter device 6 and the die-cutter device 7 and an interval between the slotter device 6 and the creaser device 5, depending on the number of printing units whose printing plates 44 need to be replaced for production of the next order, among the printing units 4*a* to 4*c*, i.e., depending on the number of printing units to be subjected to the open operation. For example, when the number of printing units whose printing plates 44 need to be replaced is two or more, the lower-level management device 110 determines to perform the open operation of widening only the interval between the slotter device 6 and the die-cutter device 7, and, when the number of printing units whose printing plates 44 need to be replaced is one, the lower-level management device 110 determines to perform the open operation of widening both the interval between the slotter device 6 and the die-cutter device 7 and the interval between the slotter device 6 and the creaser device 5.

Subsequently, in step S112, the lower-level management device 110 determines whether or not the automatic widening button 107 has been pressed by the operator. When it is determined that the automatic widening button 107 has been pressed (step S112: YES), the process proceeds to step S113. In this case, the lower-level management device 110 performs the processing device open operation according to a result of the determination in the step S111. Specifically, the lower-level management device 110 performs an open operation for one or more printing units whose printing plates 44 need to be replaced, among the printing units 4*a* to 4*c*, and one of the open operation of widening both the interval between the slotter device 6 and the die-cutter device 7 and the interval between the slotter device 6 and the creaser device 5 (see FIG. 10A), and the open operation of widening only the interval between the slotter device 6 and the die-cutter device 7 (see FIG. 10B). After the above open operation, the operator performs an operation of attaching/detaching the slotter blade 65 according to the instruction for attaching/detaching of the slotter blade 65, displayed on the slotter display device 104 (step S108). Then, the operator inputs, to the slotter operating panel 106, information about the attached/detached slotter blade 65, i.e., information about a slotter blade 65 currently attached to the slotter device 6 (e.g., the length of the slotter blade 65 (dimensions of each of the basic blade and the joint blade), etc.). On the other hand, when it is determined that the automatic widening button 107 has not been pressed (step S112: NO), the lower-level management device 110 will repeat the determination in the step S112.

Subsequently, in step S114, the lower-level management device 110 stores the information about the slotter blade 65 input to the slotter operating panel 106 by the operator in the above manner. Then, in step S115, the lower-level management device 110 performs an operation of returning the processing devices subjected to the open operation in the step S113, to their original positions (i.e., close operation), based on manipulation of a manual switch by the operator.

Subsequently, in step S116, the lower-level management device 110 determines whether or not the blade attaching/detaching completion button 108 has been pressed by the operator. When it is determined that the blade attaching/detaching completion button 108 has been pressed (step D116: YES), the process proceeds to step S117. In the step S117, through the slotter control device 126, the lower-level management device 110 performs control of positioning the stationary blade 65*a* and/or the displaceable blade 65*b* in each of the first and second slotter unit 61, 62, for the next order. On the other hand, when it is determined that the blade attaching/detaching completion button 108 has not been pressed (step S116: NO), the lower-level management device 110 will repeat the determination in the step S116.

In the above flowchart, the upper-level management device 100 is configured to determine whether or not the slotter blade 65 needs to be attached/detached, with respect to each of the plurality of orders (step S102), and the lower-level management device 110 is configured to determine whether or not a currently-attached slotter blade 65 needs to be attached/detached for the next order, by using an attaching/detaching necessity determination result corresponding to the next order, among the attaching/detaching necessity determination results with respect to the plurality of orders, transmitted from the upper-level management device 100 (steps S 105 and S106). In one modification of the above embodiment, the lower-level management device 110 may be configured to determine whether or not a currently-attached slotter blade 65 needs to be attached/detached for the next order, by performing the excess determination and the insufficiency determination in regard to the length of the currently-attached slotter blade 65, based on dimensions of a corrugated paperboard box and a production mode in the next order, without using the attaching/detaching necessity determination results with respect to the plurality of orders, from the upper-level management device 100.

Figure 15A:
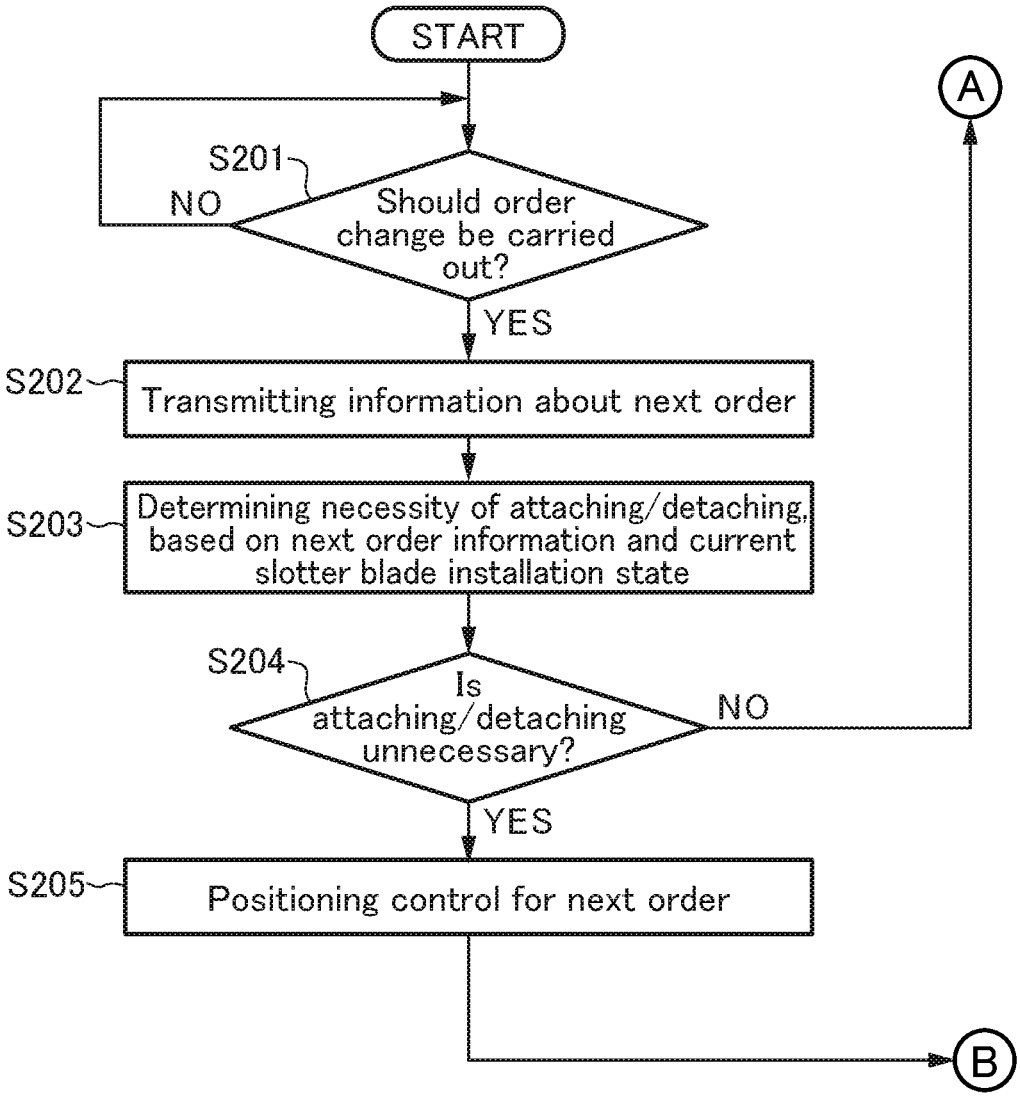
FIG. 15A is a flowchart showing a control process in one modification of this embodiment.
Figure 15B:
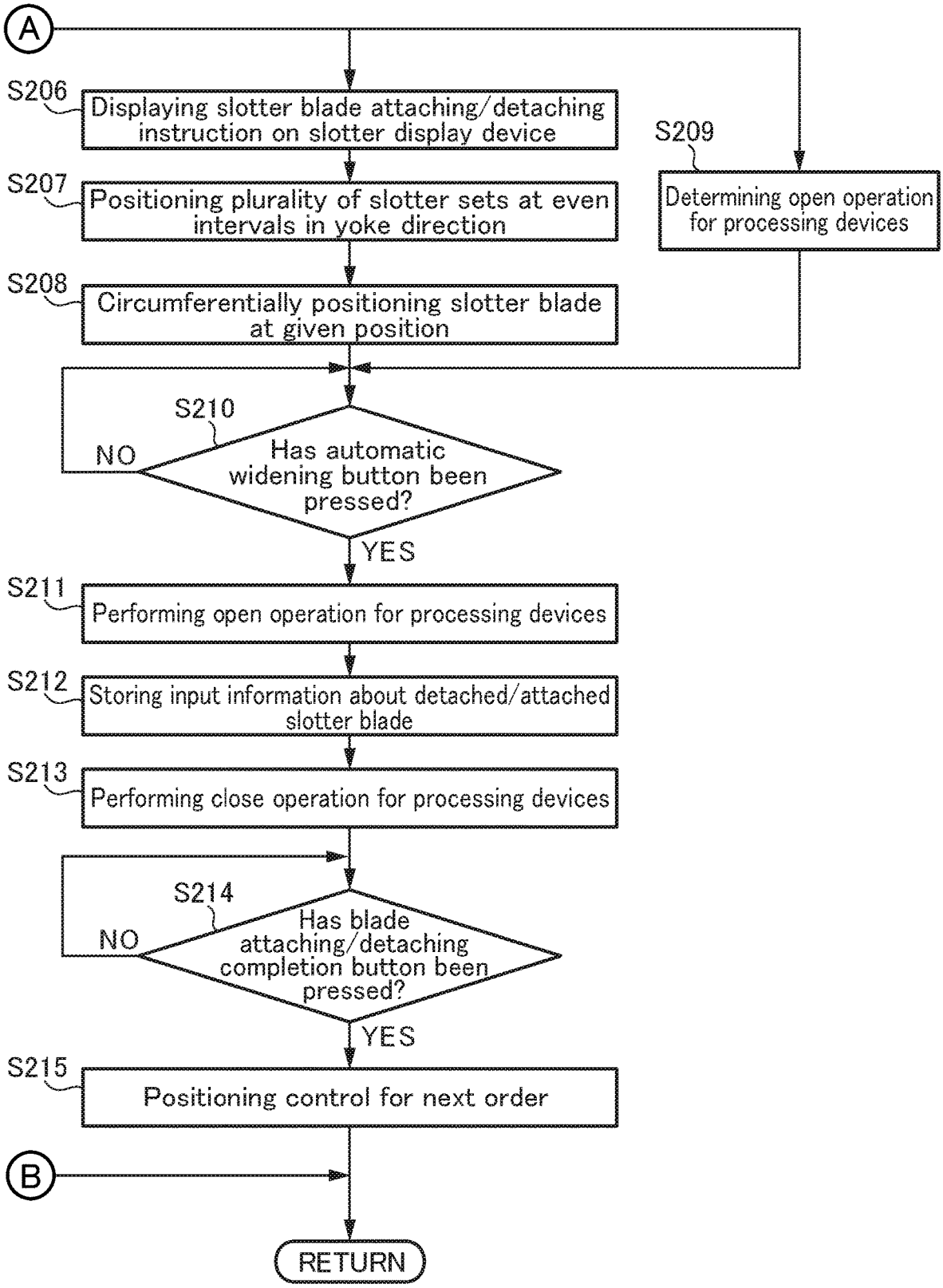
FIG. 15B is a flowchart showing the control process in the modification.

FIGS. 15A and 15B are flowcharts showing a control process in the modification of the above embodiment. Upon start of this control process, first of all, in step S201, the lower-level management device 110 determined whether or not an order change operation should be carried out. As a result, when it is determined that the order change operation should be carried out (step S201: YES), the process proceeds to step S202. On the other hand, when it is determined that the order change operation should not be carried out (step S201: NO), the determination in the step S201 will be repeated.

Subsequently, in the step S202, the upper-level management device 100 transmits, to the lower-level management device 110, information about the next order from information about a plurality of orders (i.e. production management schedule). Specifically, the upper-level management device 100 transmits, to the lower-level management device 110, information including dimensions (the flap dimension and the box depth dimension) of a corrugated paperboard box to be produced according to the next order, and a production mode (one of the first to fourth modes) to be set in the next order.

Subsequently, in step S203, the lower-level management device 110 determines whether or not a currently-attached slotter blade 65 needs to be attached/detached, based on the next order information transmitted in the step S202, and an installation state of the currently-attached slotter blade 65. Specifically, the lower-level management device 110 first sets a limit value for use in the excess determination and the insufficiency determination in regard to the length of the slotter blade 65, based on dimensions (the flap dimension and the box depth dimension) of a corrugated paperboard box and a production mode (one of the first to fourth modes) in the next order. Then, the lower-level management device 110 performs determination as to whether or not the length of the currently-attached slotter blade 65 exceeds the limit value (excess determination), and determination as to whether or not the length of the currently-attached slotter blade 65 is insufficient with respect to the limit value (insufficiency determination). Then, depending a result of the excess determination and the insufficiency determination, the lower-level management device 110 determines the necessity of attaching/detaching to/from the currently-attached slotter blade 65, i.e., determines the necessity of attaching/detaching to/from currently-attached basic blade and/or joint blade(s).

After the step S203, when the lower-level management device 110 determines that there is no necessity of attaching/detaching to/from the currently-attached basic blade and/or joint blade(s) (step S204: YES), the process proceeds to step S205, and, when the lower-level management device 110 determines that there is the necessity of attaching/detaching to/from the currently-attached basic blade and/or joint blade (s) (step S204: NO), the process proceeds to step S206. Steps S205 to S215 are the same as the aforementioned step S107 to S117, and therefore description thereof will be omitted.

<Functions and Effects>

Next, major functions and effects of the corrugated paperboard box making machine 1 according to the above embodiment will be described.

In the above embodiment, a limit value of the length of the slotter blade 65 for satisfying a given condition determined from the perimeter of the upper slotter 63, dimensions of a corrugated paperboard box to be produced by the corrugated paperboard box making machine 1, and a production mode to be set to operate the slotter device 6 in conformity to the box to be produced is set, and it is determined whether or not the length of a given slotter blade 65 to be attached to the slotter device 6 exceeds the limit value. This makes it possible to accurately perform the excess determination in regard to the length of the slotter blade 65, thereby preventing problems which would otherwise occur when the length of the slotter blade 65 is excessive.

Particularly, in the above embodiment, the limit value for the excess determination is set by using, as the given condition, a condition that the slotter device 6 does not simultaneously perform slotting on two corrugated paperboard sheets SH adjacent to each other in the conveyance direction FD. This makes it possible to reliably prevent a situation where, due to an excessive length of the slotter blade 65, the slotter device 6 simultaneously cuts slots in two corrugated paperboard sheets SH adjacent to each other in the conveyance direction FD.

Further, in the above embodiment, in the third or fourth production mode (single slotter mode for two-up production) in which two corrugated paperboard sheets SH are fed while the upper slotter 63 rotates 360 degrees, and slotting for each of the two corrugated paperboard sheets SH is performed by a respective one of the first and second slotter units 61, 62, the limit value for the excess determination is set by using, as the given condition, a condition that the stationary slotter blade 65*a* and the displaceable slotter blade 65*b* do not come into interference with each other on the outer periphery of the upper slotter 63. This makes it possible to reliably prevent a situation where, due to an excessive length of the slotter blade 65, the stationary slotter blade 65*a* and the displaceable slotter blade 65*b* come into interference (i.e., contact) with each other on the outer periphery of the upper slotter 63, in the third or fourth production mode.

Further, in the above embodiment, in the fourth production mode in which one corrugated paperboard sheet SH consisting of two continuously-connected corrugated paperboard sheet elements SH1, SH2 to be cut into front and rear parts by the die-cutter device 7 is fed during the period during which the upper slotter 63 rotates 360 degrees, and slotting for each of the one corrugated paperboard sheet SH is performed by both the first and second slotter units 61, 62, the limit value for the excess determination is set by using, as the given condition, a condition that the slotter device 6 does not perform slotting on the glue portion GL. This makes it possible to reliably prevent a situation where, due to an excessive length of the slotter blade 65, the slotter device 6 cuts the glue portion GL in the fourth production mode.

What is claimed is:

1. A corrugated paperboard box making machine comprising:

a slotter device comprising a rotatable cylinder, and a blade attached to an outer periphery of the cylinder, the slotter device being configured to perform a slotting operation for forming slots in a corrugated paperboard sheet of a various configuration by the blade cutting the corrugated paperboard sheet; and a control device configured to control the slotting operation of the slotter device, wherein the control device is configured to:

calculate a limit value of a length (S) of the blade from parameters including a circumferential length (N) of the cylinder, and dimensions (E, F, G) of the corrugated paperboard sheet, wherein the limit value is calculated based on a selected one of production modes for making the corrugated paperboard box that include a first production mode (normal production in double slotter mode), a second production mode (skip-feed production in the double slotter mode), a third production mode (two-up production in single slotter mode) and a fourth production mode (a variation of the third production mode in which adjacent two corrugated paperboard sheets are connected); and determine whether or not the length of the blade exceeds the limit value.

2. The corrugated paperboard box making machine according to claim 1, wherein the control device is configured to calculate the limit value for one of the first to the fourth production modes so that the slotter device does not simultaneously perform the slotting operation on two corrugated paperboard sheets adjacent to each other in a conveyance direction thereof during the slotting operation in said one of the first to the fourth production modes.

3. The corrugated paperboard box making machine according to claim 1, wherein the slotter device comprises a first slotter unit and a second slotter unit which are arranged side-by-side in a conveyance direction of the corrugated paperboard sheet, and each of which has the cylinder and two sets of the blades, and wherein the control device is configured to calculate the limit value for one of the third and the fourth production modes so that the two sets of blades do not come into interference with each other during the slotting operation in said one of the third and the fourth production modes.

4. The corrugated paperboard box making machine according to claim 1, wherein the slotter device comprises a first slotter unit and a second slotter unit which are arranged side-by-side in a conveyance direction of the corrugated paperboard sheet, and each of which has the cylinders and two sets of the blades, and wherein the control device is configured to calculate the limit value for the fourth production mode so that the slotter device does not perform the slotting operation on a glue portion located between a front flap and a rear flap in the corrugated paperboard sheet during the slotting operation in the fourth production mode.

5. The corrugated paperboard box making machine according to claim 1, wherein the slotter device comprises a first slotter unit and a second slotter unit which are arranged side-by-side in a conveyance direction of the corrugated paperboard sheet, and each of which has the cylinders and one set of the blades, wherein the control device is configured to calculate the limit value for the first production mode so that the slotter device does not simultaneously perform the slotting operation on two corrugated paperboard sheets adjacent to each other in the conveyance direction during the slotting operation in the first production mode, and wherein the control device is configured to calculate the limit value by subtracting a sum of a front flap dimension E or a rear flap dimension G of the corrugated paperboard sheet, a box depth dimension F thereof and a margin value O from the circumferential length N of the cylinder (N−E−F−O or N−G−F−O).

6. The corrugated paperboard box making machine according to claim 1, wherein the slotter device comprises a first slotter unit and a second slotter unit which are arranged side-by-side in a conveyance direction of the corrugated paperboard sheet, and each of which has the cylinder and one set of the blades, wherein the control device is configured to calculate the limit value for the second production mode so that the slotter device does not simultaneously perform the slotting operation on two corrugated paperboard sheets adjacent to each other in the conveyance direction, during the slotting operation in the second production mode, and wherein the control device is configured to calculate the limit value by subtracting a sum of a front flap dimension E or a rear flap dimension G of the corrugated paperboard sheet, a box depth dimension F thereof and a margin value O from a two-fold of the circumferential lengh N of the cylinder (2N−E−F−O or 2N−G−F−O).

7. The corrugated paperboard box making machine according to claim 1, wherein the slotter device comprises a first slotter unit and a second slotter unit which are arranged side-by-side in a conveyance direction of the corrugated paperboard sheet, and each of which has the cylinder and two sets of the blades, wherein the control device is configured to:

(1) calculate the limit value for the third production mode so that the slotter device does not simultaneously perform the slotting operation on two corrugated paperboard sheets adjacent to each other in the conveyance direction, during the slotting operation in the third production mode, wherein the control device is configured to subtract a sum of a front flap dimension E or a rear flap dimension G of the corrugated paperboard sheet, a box depth dimension F thereof and a margin value O from a half of the circumferential length N of the cylinder (N/2−E−F−O or N/2−G−F−O); and (2) further calculate the limit value for the third production mode so that the two sets of blades do not come into interference with each other during the slotting operation in the third production mode, wherein the control device is configured to divide by two the circumferential length N of the cylinder subtracted with the box depth dimension F and a margin value Z ((N−F−Z)/2).

8. The corrugated paperboard box making machine according to claim 1, wherein the slotter device comprises a first slotter unit and a second slotter unit which are arranged side-by-side in a conveyance direction of the corrugated paperboard sheet, and each of which has the cylinder and two sets of the blades, and wherein the control device is configured to:

(1) calculate the limit value for the fourth production mode so that the slotter device does not simultaneously perform slotting on two corrugated paperboard sheets adjacent to each other in the conveyance direction, during the slotting operation in the fourth production mode, wherein the control device is configured to subtract a sum of a front flap dimension E of the corrugated paperboard sheet or a two-fold of the front flap dimension E, a two-fold of a box depth dimension F thereof and a rear flap dimension G thereof or a two-fold of the rear flap dimension G thereof and a margin value O from the circumferential length N of the cylinder (N−E−2F−2G−O or N−2E−2F−G−O);

(2) further calculate the limit value for the fourth production mode so that the two sets of blades do not come into interference with each other during the slotting operation in the fourth production mode, wherein the control device is configured to divide by two the circumferential length N of the cylinder subtracted with the box depth dimension F and a margin value Z ((N−F−Z)/2); and (3) further calculate the limit value for the fourth production mode so that the slotter device does not perform the slotting operation on a glue portion located between a front flap and a rear flap of the corrugated paperboard sheet during the slotting operation in the fourth production mode, wherein the control device is configured to subtract a margin value Q from a sum of the front flap dimension E and the rear flap dimension G (E+G−Q).

9. The corrugated paperboard box making machine according to claim 1, further comprising a display device, wherein the control device is configured to, upon determining that the length of the blade exceeds the limit value, display on the display device a notice that a particular blade should be attached or removed.

10. The corrugated paperboard box making machine according to claim 1, wherein the blade comprises a basic blade and joint blades, and the length of the blade is represented by a sum of lengths of the basic blade and the joint blades, wherein the control device is configured to:

receive a plurality of production orders and determine, with respect to each of the plurality of production orders, whether or not the length of the blade exceeds the limit value; and further determine, with respect to each of the plurality of production orders, whether or not any of the basic blade and the joint blades need to be removed from the slotter device, according to a determination made for each of the plurality of production orders as to whether or not the length of the blade exceeds the limit value.

11. The corrugated paperboard box making machine according to claim 10, further comprising a display device, wherein the control device is configured to display, on the display device, a result of the determination, made for each of the plurality of production orders, as to whether or not any of the basic blade and the joint blades need to be removed from the slotter device.

12. The corrugated paperboard box making machine according to claim 1, comprising a plurality of processing devices arranged in a conveyance direction of the corrugated paperboard sheet, including the slotter device and an opening device configured to adjust an interval of two adjacent processing devices, wherein the control device is configured to, upon determining that the length of the blade exceeds the limit value, operate the opening device to widen an interval between the slotter device and a processing device located adjacent thereto prior to start of executing a next production order.

13. The corrugated paperboard box making machine according to claim 12, wherein the plurality of processing devices include, from upstream to downstream of a conveyance direction of the corrugated paperboard sheet: a printing device comprising two or more printing units for printing on the corrugated paperboard sheet; a creaser device for creasing the corrugated paperboard sheet; the slotter device; and a die-cutter device for punching the corrugated paperboard sheet, and wherein the control device is configured to switch, depending on a number of printing units whose printing plates need to be replaced for a next production order, between widening only an interval between the slotter device and the die-cutter device, and widening both the interval between the slotter device and the die-cutter device and an interval between the slotter device and the creaser device.

14. The corrugated paperboard box making machine according to claim 1, wherein the slotter device comprises a plurality of pairs of blades arranged orthogonal to a conveyance direction of the corrugated paperboard sheet, the blades in pair include the blade and a second blade engageable with each other, wherein the control device is configured to, upon determining that the length of the blade exceeds the limit value, perform, prior to start of executing a next production order, one or both of (i) positioning the plurality of pairs of blades at even intervals orthogonal to the conveyance direction, and (ii) adjusting a circumferential position of the blade of each pair so as to prevent the blade in a pair from engaging with the second blade in the pair.

15. The corrugated paperboard box making machine according to claim 1, wherein the control device is configured to further determine whether or not the length of the blade is insufficient to form a slot of a sufficient length in each of a front flap dimension E and a rear flap dimension G of the corrugated paperboard sheet.

* * * * *